US010083769B2

(12) United States Patent
Miyamoto et al.

(10) Patent No.: US 10,083,769 B2
(45) Date of Patent: Sep. 25, 2018

(54) TREATMENT METHOD AND TREATMENT APPARATUS OF IRON-GROUP METAL ION-CONTAINING LIQUID, METHOD AND APPARATUS FOR ELECTRODEPOSITING CO AND FE, AND DECONTAMINATION METHOD AND DECONTAMINATION APPARATUS OF RADIOACTIVE WASTE ION EXCHANGE RESIN

(71) Applicants: KURITA WATER INDUSTRIES LTD., Tokyo (JP); HITACHI-GE NUCLEAR ENERGY, LTD., Hitachi-shi, Ibaraki (JP)

(72) Inventors: Shingo Miyamoto, Tokyo (JP); Mamoru Iwasaki, Tokyo (JP); Mami Hirose, Tokyo (JP); Motohiro Aizawa, Hitachi (JP); Nobuyuki Ota, Hitachi (JP); Takako Sumiya, Hitachi (JP); Kazushige Ishida, Tokyo (JP)

(73) Assignees: KURITA WATER INDUSTRIES LTD., Tokyo (JP); HITACHI-GE NUCLEAR ENERGY, LTD., Hitachi-shi, Ibaraki (JP)

( * ) Notice: Subject to any disclaimer, the term of this patent is extended or adjusted under 35 U.S.C. 154(b) by 109 days.

(21) Appl. No.: 15/030,781

(22) PCT Filed: Oct. 20, 2014

(86) PCT No.: PCT/JP2014/077836
§ 371 (c)(1),
(2) Date: Apr. 20, 2016

(87) PCT Pub. No.: WO2015/060250
PCT Pub. Date: Apr. 30, 2015

(65) Prior Publication Data

US 2016/0247589 A1 Aug. 25, 2016

(30) Foreign Application Priority Data

Oct. 24, 2013 (JP) ..... 2013-221320
Oct. 24, 2013 (JP) ..... 2013-221321
(Continued)

(51) Int. Cl.
*G21F 9/12* (2006.01)
*G21F 9/30* (2006.01)
(Continued)

(52) U.S. Cl.
CPC ..... *G21F 9/12* (2013.01); *C25C 1/06* (2013.01); *G21F 9/00* (2013.01); *G21F 9/001* (2013.01);
(Continued)

(58) Field of Classification Search
None
See application file for complete search history.

(56) References Cited

U.S. PATENT DOCUMENTS 4,160,704 A * 7/1979 Kuo ..... C25B 1/46 205/211
5,835,865 A 11/1998 Bertholdt et al.
(Continued)

FOREIGN PATENT DOCUMENTS

CN 101665277 A 3/2010
JP H08-043595 A 2/1996
(Continued)

OTHER PUBLICATIONS

Europe Patent Office, "Search Report for European Patent Application No. 14854988.4," dated May 30, 2017.
(Continued)

*Primary Examiner* — Kishor Mayekar
(74) *Attorney, Agent, or Firm* — Manabu Kanesaka

(57) ABSTRACT

In an electrodeposition treatment of an iron-group metal ion-containing liquid, without being influenced by the properties of the iron-group metal ion-containing liquid, iron-group metal ions are efficiently removed from the liquid by precipitation. An anode chamber 2A provided with an anode 2 and a cathode chamber 3A provided with a cathode 3 are separated from each other by a cation exchange membrane 5, an iron-group metal ion-containing liquid is charged into the anode chamber 2A, a cathode liquid is charged into the cathode chamber 3A, and by applying the voltage between the anode 2 and the cathode 3, iron-group metal ions in the liquid in the anode chamber 2A are moved into the liquid in the cathode chamber 3A through the cation exchange membrane 5, so that an iron-group metal is precipitated on the cathode 3.

14 Claims, 21 Drawing Sheets

(30) Foreign Application Priority Data

Oct. 24, 2013 (JP) ..... 2013-221322
Mar. 7, 2014 (JP) ..... 2014-045235

(51) Int. Cl.
*C25C 1/06* (2006.01)
*G21F 9/06* (2006.01)
*G21F 9/00* (2006.01)

(52) U.S. Cl.
CPC ..... *G21F 9/06* (2013.01); *G21F 9/30* (2013.01); *G21Y 2002/60* (2013.01); *G21Y 2004/601* (2013.01)

(56) References Cited

U.S. PATENT DOCUMENTS

| | | | | |
|---|---|---|---|---|
| 6,063,257 | A * | 5/2000 | Kimura | C25B 9/206 204/254 |
| 2003/0178308 | A1 | 9/2003 | Wood et al. | |
| 2005/0211563 | A1 * | 9/2005 | Ivey | C25D 3/562 205/255 |
| 2007/0221506 | A1 * | 9/2007 | Murakami | C25D 21/14 205/261 |

FOREIGN PATENT DOCUMENTS

| | | | |
|---|---|---|---|
| JP | 2003-004894 | A | 1/2003 |
| JP | 2004-028697 | A | 1/2004 |
| JP | 3657747 | B2 | 3/2005 |
| JP | 2006-078336 | A | 3/2006 |
| JP | 4438988 | B2 | 1/2010 |
| JP | 2010-151596 | A | 7/2010 |
| JP | 2012-108073 | A | 6/2012 |
| JP | 2013-044588 | A | 3/2013 |
| JP | 2013-185938 | A | 9/2013 |
| WO | 2010/077403 | A1 | 7/2010 |

OTHER PUBLICATIONS

PCT/ISA/210, "International Search Report for International Application No. PCT/JP2014/077836".
Taiwan Patent Office, "Office Action for Taiwanese Patent Application No. 103136785," dated Dec. 4, 2017.

* cited by examiner

Fig.4 ELECTRODEPOSITION TEST RESULTS (REFERENCE EXAMPLES 1-7, COMPARATIVE REFERENCE EXAMPLE 6)

Fig.8 ELECTRODEPOSITION TEST RESULTS (EXAMPLES 2-8, COMPARATIVE EXAMPLE 8)

- EXAMPLE 2 DL-MALIC ACID
- EXAMPLE 3 SODIUM TARTRATE
- EXAMPLE 4 IMINODIACETIC ACID
- COMPARATIVE EXAMPLE 8 ASCORBIC ACID
- EXAMPLE 5 SUCCINIC ACID
- EXAMPLE 6 MALONIC ACID
- EXAMPLE 7 CITRIC ACID (5 TIMES IN AMOUNT)
- EXAMPLE 8 CITRIC ACID (2 TIMES IN AMOUNT)

Fig.20 PERMEATION TEST RESULTS OF CATIONIC EXCHANGE MEMBRANE

EXAMPLE 23 PERMEATION TEST RESULTS OF CATIONIC EXCHANGE MEMBRANE (ELUENT)

EXAMPLE 23 PERMEATION TEST RESULTS OF CATIONIC EXCHANGE MEMBRANE (ELECTRODEPOSITION LIQUID)

Fig.24 ELECTRODEPOSITION TEST RESULTS (COMPARATIVE EXPERIMENTAL EXAMPLE 2, EDTA)

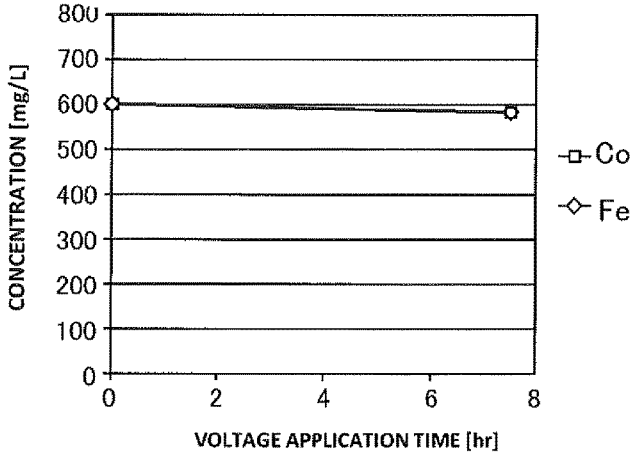

Fig.25 ELECTRODEPOSITION TEST RESULTS (EXPERIMENTAL EXAMPLES 3-9, COMPARATIVE EXPERIMENTAL EXAMPLE 6)

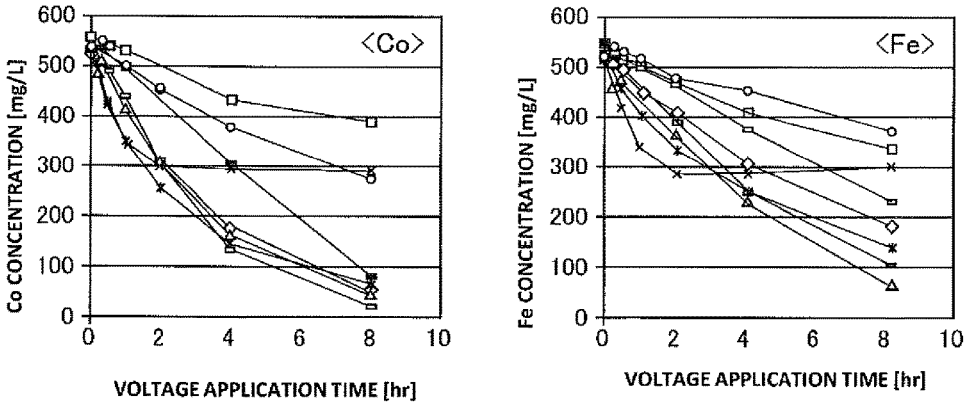

- EXPERIMENTAL EXAMPLE 3 DL-MALIC ACID
- EXPERIMENTAL EXAMPLE 4 SODIUM TARTRATE
- EXPERIMENTAL EXAMPLE 5 IMINODIACETIC ACID
- COMPARATIVE EXPERIMENTAL EXAMPLE 6 ASCORBIC ACID
- EXPERIMENTAL EXAMPLE 6 SUCCINIC ACID
- EXPERIMENTAL EXAMPLE 7 MALONIC ACID
- EXPERIMENTAL EXAMPLE 8 CITRIC ACID (5 TIMES IN AMOUNT)
- EXPERIMENTAL EXAMPLE 9 CITRIC ACID (2 TIMES IN AMOUNT)

TREATMENT METHOD AND TREATMENT APPARATUS OF IRON-GROUP METAL ION-CONTAINING LIQUID, METHOD AND APPARATUS FOR ELECTRODEPOSITING CO AND FE, AND DECONTAMINATION METHOD AND DECONTAMINATION APPARATUS OF RADIOACTIVE WASTE ION EXCHANGE RESIN

FIELD OF INVENTION

A first invention relates to a treatment method and a treatment apparatus of an iron-group metal ion-containing liquid and, more particularly, relates to a method and an apparatus in which from a liquid containing iron-group metal ions of iron (Fe), cobalt (Co), nickel (Ni), and/or the like, the ions mentioned above are removed. In particular, the first invention is preferably used for treatment of a waste liquid containing iron-group metal ions generated from a nuclear power plant or the like, such as a decontamination waste liquid generated in a nuclear power plant or an eluent eluting iron-group metal ions from an ion exchange resin used in a nuclear power plant.

A second invention relates to a method and an apparatus for electrodepositing Co and Fe and, more particularly, relates to a method and an apparatus in which from a liquid containing Co ions and Fe ions, those ions are simultaneously removed by electrodeposition. In particular, the second invention is preferably used for treatment of a waste liquid containing Co ions and Fe ions generated from a nuclear power plant or the like, such as a decontamination waste liquid generated in a nuclear power plant or a waste liquid eluting radioactive substances adsorbed to an ion exchange resin used in a nuclear power plant.

A third invention relates to a decontamination method and a decontamination apparatus in which from a waste ion exchange resin which is used in a nuclear power plant or the like and which adsorbs radioactive substances and also contains a clad primarily formed of iron oxide, the radioactive substances are efficiently removed.

BACKGROUND OF INVENTION

In a nuclear power plant, when radioactive substances are chemically removed from apparatuses and pipes of a primary cooling system contaminated by radioactive substances and from surfaces of metal members of the system including those mentioned above, a large amount of decontamination waste liquids is generated. Those decontamination waste liquids contain iron-group metal ions of Fe, Co, or Ni and also contain a large amount of radioactive substances, such as Co-60 (cobalt 60) and Ni-63 (nickel 63). In general, a decontamination waste liquid is reused after ion components dissolved therein are removed by an ion exchange resin as a decontaminated liquid. Hence, there has been a problem in that a waste ion exchange resin containing a large amount of radioactive substances is generated.

In a nuclear power plant and the like, since an ion exchange resin used for cleanup of a cooling water system, such as a reactor water cleanup system (CUW) or a fuel pool cooling cleanup system (FPC), which is directly brought into contact with a fuel rod and contains radioactive substances adsorbs a large amount of radioactive substances, as a high-dose rate waste, the above ion exchange resin is stored in a resin tank provide in the power plant.

Those wastes containing radioactive substances are stabilized by kneading with a solid-forming auxiliary agent, such as cement, and finally, burial disposal thereof is performed. The cost for the burial disposal is changed depending on the amount of contained radioactive substances and is increased as the concentration thereof is increased. Hence, it is economical that after the volume of a high-dose rate waste is reduced as much as possible, a solid waste for burial disposal is formed. In particular, if the radioactive substances can be isolated in a solid form from the ion exchange resin and can be sealed in a shielding container, it is preferable in terms of the reduction in volume. Since a waste ion exchange resin from which the radioactive substances are removed is a low-dose rate waste which can be disposed at a low cost, if the radioactive substances can be removed therefrom to a level at which the waste ion exchange resin can be incinerated, a significant reduction in volume can be achieved by an incineration treatment.

As a treatment method of a high-dose rate waste resin as described above, as proposed in Patent Literature 1 and Patent Literature 2, a Fenton method and a method for decomposing a waste resin by wet oxidation, such as supercritical water oxidation, have been known. When the methods as described above are used, in both the cases, a large amount of a high-dose rate waste liquid is generated. When this high-dose rate waste liquid is finally disposed, after evaporative concentration thereof is further performed, the concentrated liquid thus obtained is required to be stabilized in a solid form, for example, by a method for kneading the liquid with cement. In this case, since a solid-forming auxiliary agent, such as cement, is newly added, the volume of a high-dose rate waste to be finally disposed is increased by an amount corresponding to that of the agent, and as a result, a problem in that the reduction in volume of the waste cannot be achieved may arise.

Patent Literature 3 has disclosed a technique in which after sulfuric acid is allowed to pass through a waste resin to elute ionic radioactive substances therefrom, the radioactive substances are isolated from the eluent by diffusion dialysis, and the sulfuric acid is recycled. Patent Literature 4 has disclosed a waste resin treatment method in which a waste resin is immersed in an oxalic acid aqueous solution to dissolve a metal clad on the surface of the resin, and in addition, metal ions adsorbed to the resin are also eluted into the oxalic acid aqueous solution. In the cases described above, although a waste liquid containing radioactive substances is produced, the solidification treatment thereof has not been sufficiently described.

As a method for removing radioactive substances from a waste liquid containing ionic radioactive substances, Patent Literature 5 has disclosed a technique for regenerating and reusing a decontamination solution in which while a decontamination solution dissolving radioactive cations is allowed to pass through an electrodeposition cell, voltage application is performed thereon to deposit the radioactive cations on a cathode as radioactive metal grains. In this case, it has been described that a cathode liquid is pored over the entire cathode so that the radioactive metal grains are removed from the cathode on which the radioactive metal grains are deposited.

In Patent Literature 5, while the decontamination solution dissolving radioactive cations is directly charged to a cathode side of the electrodeposition cell, by applying the voltage thereon, the radioactive cations are deposited on the cathode as the radioactive metal grains. In this method, since the cathode liquid properties are changed depending on the decontamination solution, the cathode liquid cannot be adjusted to have liquid properties suitable for electrodeposition. When the decontamination solution is an acidic waste liquid, since a radioactive metal component precipitated on the cathode surface is again dissolved in the acidic waste liquid, precipitation may not occur, or the precipitation rate may be seriously decreased. When the waste liquid is neutral or alkaline, a hydroxide deposit is formed in the vicinity of the cathode surface, and the recovery of the radioactive metal by electrodeposition thereof on the cathode surface becomes difficult. Hence, in order to efficiently recover radioactive substances from a waste liquid by an electrodeposition method, direct charge of a waste liquid into a cathode chamber is not preferable, and it is important to adjust the cathode liquid to have liquid properties suitable for electrodeposition.

In addition, in order to efficiently recover radioactive substances from a waste liquid by an electrodeposition method, it is significantly important to appropriately select the liquid properties of a liquid into which the cathode is immersed.

In a nuclear power plant, since an ion exchange resin used for cleanup of a cooling water system, such as a reactor water cleanup system (CUW) or a fuel pool cooling cleanup system (FPC), which is directly brought into contact with a fuel rod and contains radioactive substances adsorbs a large amount of radioactive substances, as a high-dose rate radioactive waste, the above ion exchange resin is stored in a resin tank provide in the power plant. In a nuclear power plant, when radioactive substances are removed by chemical cleaning from apparatuses and pipes of a primary cooling system contaminated by radioactive substances and from surfaces of metal members of the system including those mentioned above, an ion exchange resin is also used, and the ion exchange resin thus used is also stored in a resin tank as a high-dose rate radioactive waste. Those wastes containing radioactive substances are stabilized by kneading with a solid-forming auxiliary agent, such as cement, and finally, burial disposal thereof is performed. The cost for the burial disposal is changed depending on the amount of contained radioactive substances and is increased as the concentration thereof is increased. Hence, it is economical that after the volume of a high-dose rate waste is reduced as much as possible, a solid waste for burial disposal is formed. In particular, if the radioactive substances can be isolated in a solid form from the ion exchange resin and can be sealed in a shielding container, it is preferable in terms of the reduction in volume. Since a waste ion exchange resin from which the radioactive substances are removed is a low-dose rate waste which can be disposed at a low cost, if the radioactive substances can be removed therefrom to a level at which the waste ion exchange resin can be incinerated, a significant reduction in volume can be achieved by an incineration treatment.

When a waste resin can be treated by incineration disposal, although a significant reduction in volume of radioactive wastes can be achieved, in this case, the radioactive substances are concentrated in incinerated ash, and hence, the incinerated ash becomes a high-dose rate material. If the radioactive substances can be completely removed from the waste resin, the incinerated ash can be prevented from becoming a high-dose rate material, and the reduction in volume can be performed by incineration; hence, various techniques for removing radioactive substances from a waste resin have been investigated.

A high-dose rate waste resin used in a reactor water cleanup system or a fuel pool cooling cleanup system adsorbs ions of radioactive substances and also contains a clad primarily formed of iron oxide. Since the clad also contains radioactive substances, in order to completely remove radioactive substances from the waste resin, the clad is also required to be simultaneously removed from the waste resin.

As the chemical form of the clad contained in the waste resin, magnetite ($Fe_3O_4$) and hematite ($\alpha$-$Fe_2O_3$) are primarily present. As a technique for removing radioactive substances from a waste resin, in Patent Literature 6, a technique has been disclosed in which after sulfuric acid is allowed to pass through an eluting device in which a waste resin is packed to elute ionic radioactive substances therefrom, from the eluent, the radioactive substances are isolated by diffusion dialysis, and the sulfuric acid is recycled. As described above, in the method in which a room-temperature sulfuric acid which is not heated is allowed to pass through a waste resin, since poor soluble hematite ($\alpha$-$Fe_2O_3$) is difficult to be dissolved, and the clad cannot be remove from the waste resin, a problem in that radioactive substances remain may arise in some cases.

PATENT LITERATURE

Patent Literature 1: Japanese Patent Publication S61-9599B

Patent Literature 2: Japanese Patent 3657747B

Patent Literature 3: Japanese Patent Publication 2004-28697A

Patent Literature 4: Japanese Patent Publication 2013-44588A

Patent Literature 5: Japanese Patent 4438988B

Patent Literature 6: Japanese Patent Publication 2004-28697A

SUMMARY OF INVENTION

A first invention aims to provide a treatment method and a treatment apparatus of an iron-group metal ion-containing liquid, in each of which in an electrodeposition treatment of an iron-group metal ion-containing liquid, iron-group metal ions are efficiently removed by precipitation without being influenced by the liquid properties of the iron-group metal ion-containing liquid.

A second invention aims to provide an electrodeposition method and an apparatus therefor, in each of which in an electrodeposition treatment of a liquid containing Co ions and Fe ions, Co and Fe are efficiently removed from the liquid while the liquid properties thereof are set suitable for electrodeposition of Co and Fe.

A third invention aims to provide a decontamination method and a decontamination apparatus, in each of which an ionic radioactive substance in a waste ion exchange resin is not only removed, but a clad is also removed by dissolution thereof, so that the radiation dose of the waste ion exchange resin is decreased to an ultra-low level.

[First Invention]

The present inventors found that in an electrodeposition bath in which an anode chamber provided with an anode and a cathode chamber provided with a cathode are separated from each other by a cation exchange membrane, when an iron-group metal ion-containing liquid is charged into the anode chamber, a cathode liquid is charged into the cathode chamber, and voltage application is performed between the anode and the cathode so as to precipitate an iron-group metal on the cathode by moving iron-group metal ions in the liquid in the anode chamber into the cathode liquid in the cathode chamber, without being influenced by the liquid properties of the iron-group metal ion-containing liquid, an iron-group metal can be removed by electrodeposition under appropriate electrodeposition conditions, and as a result, the first invention was completed.

That is, the first invention is as described below.

[1] A treatment method of an iron-group metal ion-containing liquid characterized in that an anode chamber provided with an anode and a cathode chamber provided with a cathode are separated from each other by a cation exchange membrane, an iron-group metal ion-containing liquid is charged into the anode chamber, a cathode liquid is charged into the cathode chamber, and a voltage is applied between the anode and the cathode, so that iron-group metal ions in the liquid in the anode chamber are moved into the liquid in the cathode chamber through the cation exchange membrane, and an iron-group metal is precipitated on the cathode.

[2] The treatment method of an iron-group metal ion-containing liquid according to [1], wherein the iron-group metal is at least one selected from iron, cobalt, and nickel.

[3] The treatment method of an iron-group metal ion-containing liquid according to [1] or [2], wherein the iron-group metal ion-containing liquid is an acidic waste liquid having a pH of less than 2.

[4] The treatment method of an iron-group metal ion-containing liquid according to any one of [1] to [3], wherein the cathode liquid contains at least one additive selected from a dicarboxylic acid and a salt thereof and a tricarboxylic acid and a salt thereof.

[5] A treatment apparatus of an iron-group metal ion-containing liquid, comprising: an electrodeposition bath which includes an anode chamber provided with an anode, a cathode chamber provided with a cathode, and a cation exchange membrane separating the anode chamber from the cathode chamber; a voltage applicater for applying a voltage between the anode and the cathode; a liquid passer for allowing an iron-group metal ion-containing liquid to pass through the anode chamber; and a liquid passer for allowing a cathode liquid to pass through the cathode chamber, wherein by applying the voltage between the anode and the cathode, iron-group metal ions in the liquid in the anode chamber are moved into the liquid in the cathode chamber through the cation exchange membrane, and an iron-group metal is precipitated on the cathode.

[6] The treatment apparatus of an iron-group metal ion-containing liquid according to [5], wherein the iron-group metal is at least one selected from iron, cobalt, and nickel.

[7] The treatment apparatus of an iron-group metal ion-containing liquid according to [5] or [6], wherein the iron-group metal ion-containing liquid is an acidic waste liquid having a pH of less than 2.

[8] The treatment apparatus of an iron-group metal ion-containing liquid according to any one of [5] to [7], wherein the cathode liquid contains at least one additive selected from a dicarboxylic acid and a salt thereof and a tricarboxylic acid and a salt thereof.

<Advantage of First Invention>

According to the first invention, since the anode chamber into which the iron-group metal ion-containing liquid is charged and the cathode chamber in which the iron-group metal is precipitated are separated by the cation exchanged membrane, without being influenced by the liquid properties of the iron-group metal ion-containing liquid, the electrodeposition of the iron-group metal can be efficiently performed. In particular, when the iron-group metal ion-containing liquid is an acidic waste liquid, in a related method, the iron-group metal electrodeposited on the cathode may be dissolved, or the electrodeposition rate of the iron-group metal may be seriously decreased in some cases; however, according to the present invention, even if an acidic waste liquid is charged into the anode chamber, the cathode chamber can be placed under conditions suitable for electrodeposition.

[Second Invention]

The present inventors found that when at least one type of additive selected from a dicarboxylic acid and a salt thereof and a tricarboxylic acid and a salt thereof, each of which has a specific structure, is allowed to be present in an electrodeposition liquid system, the problem described above can be resolved, and as a result, the second invention was completed.

That is, the second invention is as described below.

[1] A method for electrodepositing Co and Fe characterized in that an anode and a cathode are immersed in a liquid containing Co ions and Fe ions and at least one additive selected from a dicarboxylic acid and a salt thereof and a tricarboxylic acid and a salt thereof, each of which is represented by the following formula (1), and by applying a voltage between the anode and the cathode, Co and Fe are precipitated on the cathode.

$$M^1OOC—(CHX^1)_a—(NH)_b—(CX^2X^4)_c—CX^3X^5—COOM^2 \quad (1)$$

In the formula (1), $X^1$, $X^2$, and $X^3$ each independently represent H or OH, $X^4$ and $X^5$ each independently represent H, OH, or $COOM^3$, $M^1$, $M^2$, and $M^3$ each independently represent H, a monovalent alkali metal, or an ammonium ion, and a, b, and c each independently represent an integer of 0 or 1. However, in the formula (1), $X^4$ and $X^5$ do not simultaneously represent $COOM^3$.

[2] A method for electrodepositing Co and Fe characterized in that an anode chamber provided with an anode is separated from a cathode chamber provided with a cathode by a cation exchange membrane, a liquid containing Co ions and Fe ions is charged into the anode chamber, a liquid containing at least one additive selected from a dicarboxylic acid and a salt thereof and a tricarboxylic acid and a salt thereof, each of which is represented by the following formula (1), is charged into the cathode chamber, and a voltage is applied between the anode and the cathode, so that Co ions and Fe ions in the liquid in the anode chamber are moved into the liquid in the cathode chamber through the cation exchange membrane, and Co and Fe are precipitated on the cathode.

$$M^1OOC—(CHX^1)_a—(NH)_b—(CX^2X^4)_c—CX^3X^5—COOM^2 \quad (1)$$

In the formula (1), $X^1$, $X^2$, and $X^3$ each independently represent H or OH, $X^4$ and $X^5$ each independently represent H, OH, or $COOM^3$, $M^1$, $M^2$, and $M^3$ each independently represent H, a monovalent alkali metal, or an ammonium ion, and a, b, and c each independently represent an integer of 0 or 1. However, in the formula (1), $X^4$ and $X^5$ do not simultaneously represent $COOM^3$.

[3] The method for electrodepositing Co and Fe according to [1] or [2], wherein the dicarboxylic acid is at least one selected from malonic acid, succinic acid, malic acid, tartaric acid, and iminodiacetic acid.

[4] The method for electrodepositing Co and Fe according to any one of [1] to [3], wherein the tricarboxylic acid is citric acid.

[5] The method for electrodepositing Co and Fe according to any one of [1] to [4], wherein the liquid containing an additive contains an ammonium salt.

[6] The method for electrodepositing Co and Fe according to [5], wherein the ammonium salt is at least one selected from ammonium chloride, ammonium sulfate, and ammonium oxalate.

[7] The method for electrodepositing Co and Fe according to [5], wherein the tricarboxylic acid is ammonium citrate.

[8] An apparatus for electrodepositing Co and Fe, comprising: an electrodeposition bath holding a liquid which contains Co ions and Fe ions and at least one additive selected from a dicarboxylic acid and a salt thereof and a tricarboxylic acid and a salt thereof, each of which is represented by the following formula (1); an anode and a cathode provided in the liquid in the electrodeposition bath; and a voltage applicater for applying a voltage between the anode and the cathode, wherein by applying the voltage between the anode and the cathode, Co and Fe are precipitated on the cathode.

$$M^1OOC—(CHX^1)_a—(NH)_b—(CX^2X^4)_c—CX^3X^5—COOM^2 \quad (1)$$

In the formula (1), $X^1$, $X^2$, and $X^3$ each independently represent H or OH, $X^4$ and $X^5$ each independently represent H, OH, or $COOM^3$, $M^1$, $M^2$, and $M^3$ each independently represent H, a monovalent alkali metal, or an ammonium ion, and a, b, and c each independently represent an integer of 0 or 1. However, in the formula (1), $X^4$ and $X^5$ do not simultaneously represent $COOM^3$.

[9] An apparatus for electrodepositing Co and Fe, comprising: an electrodeposition bath which includes an anode chamber provided with an anode, a cathode chamber provided with a cathode, and a cation exchange membrane separating the anode chamber from the cathode chamber; a voltage applicater for applying a voltage between the anode and the cathode; a liquid passer for allowing a liquid containing Co ions and Fe ions to pass through the anode chamber; and a liquid passer for allowing a liquid containing at least one additive selected from a dicarboxylic acid and a salt thereof and a tricarboxylic acid and a salt thereof, each of which is represented by the following formula (1), wherein by applying a voltage between the anode and the cathode, Co ions and Fe ions in the liquid in the anode chamber are moved into the liquid in the cathode chamber through the cation exchange membrane, and Co and Fe are precipitated on the cathode.

$$M^1OOC—(CHX^1)_a—(NH)_b—(CX^2X^4)_c—CX^3X^5—COOM^2 \quad (1)$$

In the formula (1), $X^1$, $X^2$, and $X^3$ each independently represent H or OH, $X^4$ and $X^5$ each independently represent H, OH, or $COOM^3$, $M^1$, $M^2$, and $M^3$ each independently represent H, a monovalent alkali metal, or an ammonium ion, and a, b, and c each independently represent an integer of 0 or 1. However, in the formula (1), $X^4$ and $X^5$ do not simultaneously represent $COOM^3$.

[10] The apparatus for electrodepositing Co and Fe according to [8] or [9], wherein the dicarboxylic acid is at least one selected from malonic acid, succinic acid, malic acid, tartaric acid, and iminodiacetic acid.

[11] The apparatus for electrodepositing Co and Fe according to any one of [8] to [10], wherein the tricarboxylic acid is citric acid.

[12] The apparatus for electrodepositing Co and Fe according to any one of [8] to [11], wherein the liquid containing an additive contains an ammonium salt.

[13] The apparatus for electrodepositing Co and Fe according to [12], wherein the ammonium salt is at least one selected from ammonium chloride, ammonium sulfate, and ammonium oxalate.

[14] The apparatus for electrodepositing Co and Fe according to [12], wherein the tricarboxylic acid is ammonium citrate.

<Advantage of Second Invention>

According to the second invention, when Co and Fe are electrodeposited on the cathode by voltage application on the waste liquid containing Co ions and Fe ions, at least one type of additive selected from a dicarboxylic acid and a salt thereof and a tricarboxylic acid and a salt thereof, each of which has a specific structure, is allowed to be present in the liquid. Hence, the liquid properties can be made suitable for electrodeposition, and without causing a problem in that, for example, the voltage application treatment cannot be continued due to the generation of a suspended material having poor precipitation properties or due to the precipitation of a non-electrical conductive precipitate, Co and Fe can be simultaneously and efficiently removed by electrodeposition.

[Third Invention]

The present inventors found that by the use of an acid heated to a predetermined temperature, an ionic radioactive substance in a waste ion exchange resin can be not only removed by elution, but a clad can also be removed by dissolution, and that an acidic waste liquid obtained by this decontamination treatment can be recycled by an electrodeposition treatment, and as a result, the third invention was completed.

That is, the third invention is as described below.

[1] A decontamination method of a radioactive waste ion exchange resin, comprising a decontamination step in which an acid heated to 60° C. or more is brought into contact with a waste ion exchange resin which adsorbs a radioactive substance and simultaneously contains a clad primarily formed of iron oxide, so that an ionic radioactive substance in the waste ion exchange resin is removed by elution, and the clad is also removed by dissolution.

[2] The decontamination method of a radioactive waste ion exchange resin according to [1], wherein the acid is sulfuric acid and/or oxalic acid.

[3] The decontamination method of a radioactive waste ion exchange resin according to [1] or [2], wherein the acid is a sulfuric acid solution having a concentration of 5 to 40 percent by weight and/or an oxalic acid solution having a concentration of 0.1 to 40 percent by weight.

[4] The decontamination method of a radioactive waste ion exchange resin according to any one of [1] to [3], wherein the radioactive substance contains cobalt-60.

[5] The decontamination method of a radioactive waste ion exchange resin according to any one of [1] to [4], wherein the method comprises: an electrodeposition step in which an acidic waste liquid containing an ionic radioactive substance discharged from the decontamination step is charged into an electrodeposition bath including an anode and a cathode, and by applying the voltage between the anode and the cathode, the ionic radioactive substance in the acidic waste liquid is electrodeposited on the cathode, so that the ionic radioactive substance is removed from the acidic waste liquid; and a circulation step in which a treated liquid obtained by removing the ionic radioactive substance in the electrodeposition step is circulated to the decontamination step and is reused.

[6] The decontamination method of a radioactive waste ion exchange resin according to [5], wherein in the electrodeposition bath, an anode chamber provided with an anode and a cathode chamber provided with a cathode are separated from each other by a cation exchange membrane, the acidic waste liquid is charged into the anode chamber, and by applying the voltage between the anode and the cathode, the ionic radioactive substance in the acidic waste liquid is moved into the cathode chamber through the cation exchange membrane and is electrodeposited on the cathode.

[7] The decontamination method of a radioactive waste ion exchange resin according to [5] or [6], wherein on the cathode, cobalt-60 and iron which is a dissolved material of the clad are electrodeposited.

[8] A decontamination apparatus of a radioactive waste ion exchange resin, comprising a decontaminater in which an acid heated to 60° C. or more is brought into contact with a waste ion exchange resin which adsorbs a radioactive substance and simultaneously contains a clad primarily formed of iron oxide, so that an ionic radioactive substance in the waste ion exchange resin is removed by elution, and the clad is also removed by dissolution, wherein the decontaminater includes a packed tower in which the waste ion exchange resin is packed, a charging pipe charging the heated acid into the packed tower, a heater provided for the charging pipe, and a discharging pipe discharging an acidic waste liquid containing an ionic radioactive substance from the packed tower.

[9] The decontamination apparatus of a radioactive waste ion exchange resin according to [8], wherein the apparatus comprises an electrodeposition bath including an anode and a cathode, a voltage applier for applying a voltage between the anode and the cathode, a charger for charging the acidic waste liquid into the electrodeposition bath, and a circulater for circulating a treated liquid in the electrodeposition bath to an upstream side of the heating means, and by applying the voltage between the anode and the cathode, the ionic radioactive substance in the acidic waste liquid is electrodeposited on the cathode, so that the ionic radioactive substance is removed from the acidic waste liquid, and a treated liquid obtained by the removal of the ionic radioactive substance is reused in the decontamination means.

[10] The decontamination apparatus of a radioactive waste ion exchange resin according to [9], wherein the electrodeposition bath includes an anode chamber provided with an anode, a cathode chamber provided with a cathode, and a cation exchange membrane separating the anode chamber from the cathode chamber, the acidic waste liquid is charged into the anode chamber, and by applying the voltage between the anode and the cathode, the ionic radioactive substance in the acidic waste liquid is moved into the cathode chamber through the cation exchange membrane and is electrodeposited on the cathode.

[11] The decontamination apparatus of a radioactive waste ion exchange resin according to [9] or [10], wherein on the cathode, cobalt-60 and iron which is a dissolved material of the clad are electrodeposited.

<Advantage of Third Invention>

According to the third invention, since the acid heated to 60° C. or more is brought into contact with the waste ion exchange resin, radioactive metal ions adsorbed to a cationic exchange resin of the waste ion exchange resin can be removed by elution by ion exchange with $H^+$ ions, and the clad containing hematite mixed in the waste ion exchange resin can be also efficiently removed by dissolution thereof.

In addition, when an acidic waste liquid containing radioactive metal ions discharged by this decontamination treatment and iron ions which are dissolved materials of the clad is charged into the electrodeposition bath in which the anode and the cathode are provided, and when the voltage application is performed between the anode and the cathode, the radioactive metal ions and the iron ions can be simultaneously removed by electrodeposition thereof on the cathode, and the electrodeposition treated liquid can be reused for the decontamination treatment of the waste ion exchange resin. In addition, when electrodeposition is performed after the electrode used for the electrodeposition is changed or the electrodeposition layer on the electrode is removed, the decontamination of the waste ion exchange resin and the removal of radioactive substances from the acidic waste liquid can be continuously performed, and a large amount of waste ion exchange resins can be treated.

According to the third invention, a waste ion exchange resin, the radioactive dose of which is decreased to an ultra-low level, can be obtained, and an incineration treatment of the treated waste ion exchange resin can be performed. In addition, when the waste ion exchange resin is incinerated to form incinerated ash, the volume can be reduced to 1/100 to 1/200.

BRIEF DESCRIPTION OF DRAWINGS

FIG. 24 is a graph showing electrodeposition test results of Comparative Experimental Example 2.

FIG. 25 is a graph showing electrodeposition test results of Experimental Examples 3 to 9 and Comparative Experimental Example 6.

DESCRIPTION OF EMBODIMENTS

[Embodiment of First Invention]

Hereinafter, with reference to the drawings, an embodiment of the first invention will be described in detail.

Figure 1:
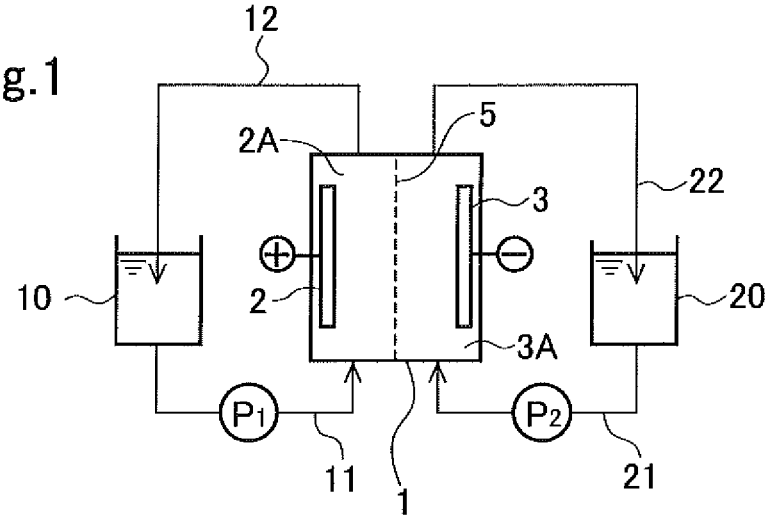
FIG. 1 is a systematic diagram of a treatment apparatus showing one example of an embodiment.

FIG. 1 is a systematic diagram showing one example of an embodiment of a treatment apparatus of an iron-group metal ion-containing liquid according to the first invention.

In an electrodeposition apparatus shown in FIG. 1, an anode chamber 2A provided with an anode 2 and a cathode chamber 3A provided with a cathode 3, each of which is placed in an electrodeposition bath 1, are separated from each other by a cation exchange membrane 5, an iron-group metal ion-containing liquid is allowed to pass through the anode chamber 2A, a cathode liquid is allowed to pass through the cathode chamber 3A, and voltage application is performed between the anode 2 and the cathode 3, so that iron-group metal ions in the liquid in the anode chamber 2A are moved into the liquid in the cathode chamber 3A through the cation exchange membrane 5, and an iron-group metal is precipitated on the cathode 3.

In FIG. 1, reference numeral 10 indicates an iron-group metal ion-containing liquid bath, and a circulation system is formed so that the iron-group metal ion-containing liquid is charged into the anode chamber 2A by a pump $P_1$ through a pipe 11, and a discharged liquid is returned to the iron-group metal ion-containing liquid bath 10 through a pipe 12. Reference numeral 20 indicates a cathode liquid storage bath, and a circulation system is formed so that the cathode liquid is charged into the cathode chamber 3A by a pump $P_2$ through a pipe 21, and a discharged liquid is returned to the cathode liquid storage bath 20 through a pipe 22.

If a waste liquid is directly charged into a bath in which the cathode is immersed without providing the cation exchange membrane, in the case in which the pH of the waste liquid is less than 2, and in particular, in the case in which the waste liquid is a strong-acid liquid having a pH of less than 1, unless otherwise the pH is appropriately adjusted using an alkali, a problem, such as re-dissolution of an iron-group metal electrodeposited on the cathode or no occurrence of the electrodeposition, may arise in some cases. On the other hand, in the apparatus in which the cation exchange membrane is provided as shown in FIG. 1, as long as the cathode liquid at the cathode side is placed under conditions suitable for electrodeposition, even if the waste liquid is a strong-acid liquid having the pH as described above, the iron-group metal can be preferably removed by electrodeposition.

In the case in which a strong-acid waste liquid is reused after iron-group metal ions are removed therefrom, when a pH adjustment of the waste liquid is performed using an alkali, the waste liquid is difficult to be reused as a strong-acid liquid; however, in the apparatus shown in FIG. 1, without decreasing the acidity of the waste liquid, iron-group metal ions can be removed from the waste liquid through the cation exchange membrane, and a treated liquid thus obtained can be reused.

In the first invention, as shown in FIG. 1, since the iron-group metal ions are moved into the cathode liquid through the cation exchange membrane, even if the concentration of the iron-group metal ions is low, such as 0.1 to 10,000 mg/L, and in particular, such as approximately 1 to 1,000 mg/L, the waste liquid can be efficiently treated.

The pH of the cathode liquid used in the first invention is preferably set to 1 to 9, and more preferably set to 2 to 8. When the pH of the cathode liquid is excessively low, re-dissolution of an iron-group metal electrodeposited on the cathode may occur, and the electrodeposition rate may be decreased in some cases. When the pH of the cathode liquid is excessively high, a hydroxide of the iron-group metal is liable to be generated in the liquid as a suspended material. Hence, in the case in which the pH of the cathode liquid is out of the range described above, by using an alkali or an acid, an appropriate pH adjustment is preferably performed.

In the first invention, a complexing agent (hereinafter, referred to as an additive in some cases) suitable for electrodeposition of iron-group metal ions is preferably added to the cathode liquid.

As the additive, a compound selected from a dicarboxylic acid having 2 carboxylic groups in its molecule and a salt thereof (hereinafter, referred to as "dicarboxylic acid (salt)" in some cases) and a tricarboxylic acid having 3 carboxylic groups in its molecule and a salt thereof (hereinafter, referred to as "tricarboxylic acid (salt)" in some cases) is preferable. Those compounds may be used alone, or at least two types thereof may be used by mixing. The dicarboxylic acid (salt) and the tricarboxylic acid (salt) each suppress the generation of a suspended material during electrodeposition by its chelating effect, and as a result, an excellent effect of improving an electrodeposition effect can be obtained.

On the other hand, since a monocarboxylic acid having 1 carboxylic group in its molecule has a weak bonding force to iron-group metal ions, problems in that a suspended material formed from a hydroxide of the iron-group metal is generated in the liquid and/or electrodeposition is not uniformly performed on the cathode may occur. When a carboxylic acid having at least 4 carboxylic groups in its molecule is used, since a bonding force to iron-group metal ions is excessively high, the iron-group metal is held in the liquid, and as a result, a problem in that the electrodeposition rate is seriously decreased may occur.

As the dicarboxylic acid (salt) and the tricarboxylic acid (salt), a compound represented by the following formula (1) is particularly preferable since a suspended material is not likely to be generated, and electrodeposition is rapidly advanced. In the dicarboxylic acid (salt) and the tricarboxylic acid (salt) each represented by the following formula (1), 1 to 3 carbon atoms are present between the intramolecular carboxylic groups, and because of the shape thereof, it is estimated that an appropriate bonding force to the iron-group metal ions can be obtained.

$$M^1OOC—(CHX^1)_a—(NH)_b—(CX^2X^4)_c—CX^3X^5—COOM^2 \quad (1)$$

In the formula (1), $X^1$, $X^2$, and $X^3$ each independently represent H or OH, $X^4$ and $X^5$ each independently represent H, OH, or $COOM^3$, $M^1$, $M^2$, and $M^3$ each independently represent H, a monovalent alkali metal, or an ammonium ion, and a, b, and c each independently represent an integer of 0 or 1. However, in the formula (1), $X^4$ and $X^5$ do not simultaneously represent $COOM^3$.

As a dicarboxylic acid preferable for the first invention, although oxalic acid (ethane dicarboxylic acid, HOOC—COOH), malonic acid (propane dicarboxylic acid, HOOC—

$CH_2$—COOH), succinic acid (butane dicarboxylic acid, HOOC—$CH_2$—$CH_2$—COOH), glutaric acid (pentane dicarboxylic acid, HOOC—$CH_2$—$CH_2$—$CH_2$—COOH), malic acid (2-hydroxybutane dicarboxylic acid, HOOC—$CH_2$—CH(OH)—COOH), tartaric acid (2,3-dihydroxybutane dicarboxylic acid, HOOC—CH(OH)—CH(OH)—COOH), iminodiacetic acid (HOOC—$CH_2$—NH—$CH_2$—COOH), and the like may be mentioned, malonic acid, succinic acid, malic acid, tartaric acid, and iminodiacetic acid are particularly preferable. As the tricarboxylic acid, although citric acid (HOOC—$CH_2$—COH(COOH)—$CH_2$—COOH), 1,2,3-propane tricarboxylic acid, and the like may be mentioned, citric acid is particularly preferable. In addition, as the salts of those dicarboxylic acid and tricarboxylic acid, alkali meal salts, such as a sodium salt and a potassium salt, and ammonium salts may be mentioned.

In the first invention, in the case in which the iron-group metal ion-containing liquid contains at least two types of iron-group metal ions, an ammonium salt is preferably present together with the dicarboxylic acid (salt) and/or the tricarboxylic acid (salt). For example, in the case in which an iron-group metal ion-containing liquid containing Co and Fe is treated by the present invention, when an ammonium salt is not added, the electrodeposition rate of Co is generally faster than that of Fe, and an electrodeposition layer of Fe is formed on an electrodeposition layer of Co; however, by the addition of an ammonium salt, the electrodeposition rates of Co and Fe become approximately equivalent to each other, and Co and Fe are electrodeposited so as to form an alloy. When the electrodeposition rates of Co and Fe are different from each other, and a Co layer and an Fe layer are separately electrodeposited, because of the difference in physical properties of Co and Fe, floating and/or peeling of an electrodeposition material is liable to occur, and a successive electrodeposition treatment may not be performed in some cases.

As the ammonium salt, any salt generating ammonium ions may be used, and for example, ammonium chloride, ammonium sulfate, ammonium oxalate, and ammonium citrate are preferable. Those ammonium salts may be used alone, or at least two types thereof may be used by mixing. In particular, when an ammonium dicarboxylate, such as ammonium oxalate, or an ammonium tricarboxylate, such as ammonium citrate, is used, since the above compound may function as both the ammonium salt and the additive, an effect of suppressing the generation of a suspended material obtained by the chelating effect of the dicarboxylic acid or the tricarboxylic acid and an effect of adjusting the electrodeposition rates of Co and Fe can be simultaneously obtained by one chemical agent.

Although the concentration of the additive in the cathode liquid is not particularly limited, with respect to the total molar concentration of iron-group metal ions in the iron-group metal ion-containing liquid charged into the anode chamber, the molar concentration of the additive in the cathode liquid charged into the cathode chamber is preferably 0.1 to 50 times, and particularly preferably 0.5 to 10 times, and as the cathode liquid, for example, an aqueous solution containing 0.01 to 20 percent by weight of the additive and preferably 0.1 to 5 percent by weight thereof and having a pH of 1 to 9 and preferably a pH of 2 to 8 is used. When the amount of the additive is excessively small, the effect of suppressing the generation of a suspended material obtained by addition of the additive cannot be sufficiently obtained, and when the amount of the additive is excessively large, the chelating effect is excessively enhanced, the electrodeposition rate is decreased.

Although the additive described above is decomposed by oxidation when being brought into contact with the anode of the electrodeposition bath, in the electrodeposition bath described above, since the anode chamber is separated from the cathode chamber by the cation exchange membrane, the electrodeposition liquid in which the additive is contained is not directly brought into contact with the anode, and hence, the additive is not wastefully consumed by oxidation. Accordingly, the amount of the additive to be replenished into the cathode liquid may be small, and the amount of the chemical agent to be consumed can be decreased.

In the case in which the ammonium salt is used, the ammonium salt is preferably used in an amount so that the concentration thereof in the cathode liquid is 0.01 to 20 percent by weight and preferably 0.1 to 5 percent by weight. When the concentration of the ammonium salt is excessively low, the effect described above by the use of the ammonium salt may not be sufficiently obtained, and when the concentration is excessively high, the effect cannot be improved, and the amount of the chemical agent to be consumed is increased.

Although the electrodeposition conditions (such as the current, the current density, and the temperature) are not particularly limited, the current density is preferably set to 5 to 600 $mA/cm^2$ with respect to the cathode area in terms of the electrodeposition efficiency.

Although the iron-group metal ion-containing liquid is generally a liquid containing ions of at least one type of iron, manganese, cobalt, and nickel, and in particular, ions of at least one type of iron, cobalt, and nickel, even if a metal other than the iron-group metals is contained, no problems may arise.

The first invention is preferable for treatment of a radioactive iron-group metal ion-containing waste liquid generated from a nuclear power plant or the like, such as a decontamination waste liquid generated in a nuclear power plant or an eluent eluting iron-group metal ions from an ion exchange resin used in a nuclear power plant, and in particular, is preferable for treatment of an acidic waste liquid having a pH of less than 2, and by efficiently removing the iron-group metal ions from those waste liquids, a treated liquid obtained thereby can be reused.

Figure 2:
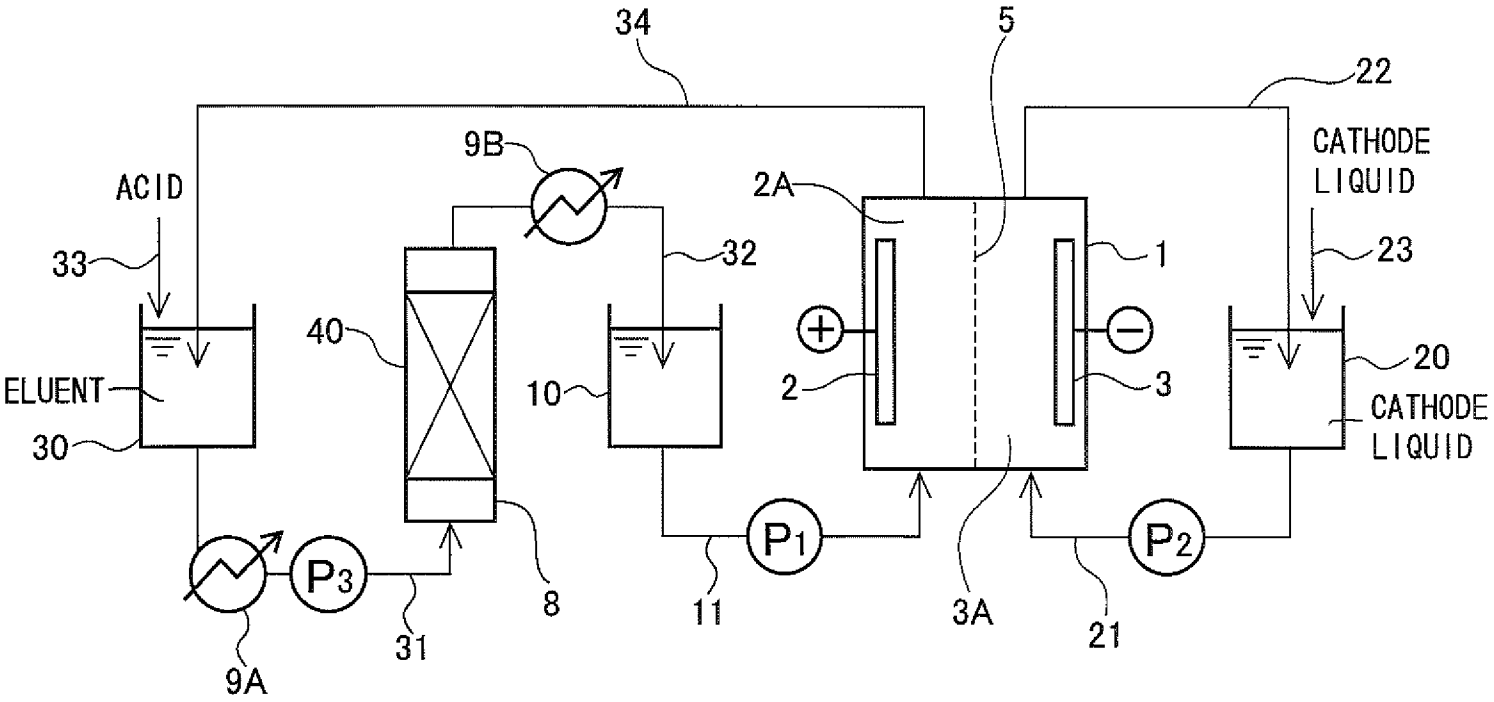
FIG. 2 is a systematic diagram of a treatment apparatus showing one example of the embodiment.

Hereinafter, an example in which the first invention is applied to a decontamination step of a waste ion exchange resin used in a nuclear power plant will be described with reference to FIG. 2. In FIG. 2, a member having the same function as that of the member shown in FIG. 1 is designated by the same reference numeral as described above.

An apparatus shown in FIG. 2 includes an eluent storage bath 30 storing an eluent eluting iron-group metal ions from a waste ion exchange resin, an eluting bath 8 which is a packed tower in which a waste ion exchange resin 40 is packed, an iron-group metal ion-containing liquid storage bath 10 which is an acidic waste liquid storage bath storing an acidic waste liquid discharged from the eluting bath 8, an electrodeposition bath 1 into which an acidic waste liquid from the iron-group metal ion-containing liquid storage bath (acidic waste liquid storage bath) 10 is charged, and a cathode liquid storage bath 20 storing a cathode liquid to be supplied to the electrodeposition bath 1. The electrodeposition bath 1 has the structure in which an anode chamber 2A including an anode 2 and a cathode chamber 3A including a cathode 3 are separated from each other by a cation exchange membrane 5, the acidic waste liquid from the iron-group metal ion-containing liquid storage bath (acidic waste liquid storage bath) 10 is allowed to pass through the anode chamber 2A, and the cathode liquid is allowed to pass through the cathode chamber 3A. Reference numerals 9A and 9B each indicate a heat exchanger.

The eluent in the eluent storage bath 30 is heated by the heat exchanger 9A to 60° C. or more, preferably 70° C. to 120° C., and more preferably 80° C. to 100° C. while being transported to the eluting bath 8 by a pump $P_3$ through a pipe 31 and is then allowed to pass through the eluting bath 8 in an upward flow. An outflow liquid (acidic waste liquid) is subsequently cooled by the heat exchanger 9B to a temperature of less than 60° C., such as 10° C. to less than 60° C., at which the cation exchange membrane 5 in the electrodeposition bath 4 is not so much degraded and is further transported to the iron-group metal ion-containing liquid storage bath (acidic waste liquid storage bath) 10 through a pipe 32. The acidic waste liquid in the iron-group metal ion-containing liquid storage bath (acidic waste liquid storage bath) 10 is charged into the anode chamber 2A of the electrodeposition bath 1 by a pump $P_1$ through a pipe 11, and an electrodeposition treated liquid is circulated to the eluent storage bath 30 through a pipe 34 and is reused as the eluent.

Into the cathode chamber 3A of the electrodeposition bath 1, the cathode liquid in the cathode liquid storage bath 20 is charged by a pump $P_2$ through a pipe 21 and is then returned to the cathode liquid storage bath 20 through a pipe 22.

An acid is appropriately replenished into the eluent storage bath 30 by a pipe 33, and into the cathode liquid storage bath 20, the cathode liquid is replenished by a pipe 23.

In this apparatus, since the heated eluent is allowed to pass through the eluting bath 8 in which the waste ion exchange resin 40 is packed, ionic radioactive nuclear species adsorbed to the waste ion exchange resin 40 are removed by elution, and in addition, a clad mixed in the waste ion exchange resin 40 or incorporated in resin particles is also removed by dissolution. After being brought into contact with the waste ion exchange resin 40, the eluent (acidic waste liquid) containing ionic radioactive nuclear species and a dissolved material of the clad is charged into the anode chamber 2A of the electrodeposition bath 1 through the iron-group metal ion-containing liquid storage bath (acidic waste liquid storage bath) 10. When the voltage is applied between the anode 2 and the cathode 3 of the electrodeposition bath 1, iron-group metal ions, such as radioactive metal ions in the acidic waste liquid and iron ions derived from the clad, are moved into the cathode chamber 3A through the cation exchange membrane 5 and are electrodeposited on the cathode 3. A treated liquid of the acid waste liquid from which the iron-group metal ions are removed in the electrodeposition bath 1 is returned to the eluent storage bath 30 and is recycled.

The cathode liquid in the cathode chamber 3A is circulated through the cathode liquid storage bath 20 by the pump $P_2$ and is recycled while the cathode liquid in an amount corresponding to the decrease thereof is added to the cathode liquid storage bath 20.

In the apparatus shown in FIG. 2, as the eluent used for decontamination of the waste ion exchange resin, an acidic eluent heated to 60° C. or more is preferably used. By the use of the heated acidic eluent, radioactive metal ions adsorbed to a cationic exchange resin of the waste ion exchange resin can be removed by elution through ion exchange with $H^+$ ions, and in addition, the clad mixed in the waste ion exchange resin can be also efficiently removed by dissolution.

As the acidic eluent, an inorganic acid, such as sulfuric acid, hydrochloric acid, or nitric acid, or an organic acid, such as formic acid, acetic acid, or oxalic acid, may be used. Those acids may be used alone, or at least two types thereof may be used by mixing. Sulfuric acid and/or oxalic acid, each of which is not likely to be volatilized during heating and is not categorized as a hazardous material, is preferably used.

As for the acid concentration in the eluent, a preferable concentration is present in accordance with an acid to be used. The sulfuric acid concentration is preferably 5 to 40 percent by weight and more preferably 10 to 30 percent by weight. The oxalic acid concentration is preferably 0.1 to 40 percent by weight and more preferably 1 to 20 percent by weight. When the acid concentration is lower than the range described above, the dissolution efficiency of hematite ($\alpha$-$Fe_2O_3$) which is a primary component of the clad is decreased. The clad is present so as to be mixed in the waste ion exchange resin or incorporated in the resin, and the primary component of the clad is poor soluble hematite, so that dissolution thereof is difficult by a low concentration acid. When the acid concentration in the eluent is high, the amount of hydrogen generated in the electrodeposition bath provided at a latter stage becomes excessive, and the electrodeposition efficiency is decreased.

In the apparatus shown in FIG. 2, when a substance, such as Cobalt-60 or Nickel-63, which is contained in the radioactive waste ion exchange resin and which forms metal cations by dissolution is electrodeposited on the cathode, the radioactive substance can be highly concentrated. In addition, a waste ion exchange resin in which the radioactive dose is decreased to an ultra-low level can be obtained, and the waste ion exchange resin thus treated can be processed by an incineration treatment. When the waste ion exchange resin is formed into incinerated ash by incineration, the volume of the waste can be reduced to 1/100 to 1/200.

FIGS. 1 and 2 each show one example of a treatment apparatus preferable for the embodiment of the first invention, and the treatment apparatus of the first invention is not limited at all to those shown in the drawings.

In the apparatuses shown in FIGS. 1 and 2, although the electrodeposition bath 1 is a closed system, since a hydrogen gas is generated from the cathode, an open system in which an upper portion is opened is preferable. When a cathode on which a metal is electrodeposited is changed, the change thereof can be easily performed if the upper portion of the electrodeposition bath is opened. In FIG. 2, although being allowed to pass through the eluting bath 8 in an upward flow, the eluent may pass therethrough in a downward flow. When the waste ion exchange resin is a powder, the differential pressure is liable to increase when the liquid is allowed to pass therethrough, and hence the upward flow is preferable. In the electrodeposition bath 1, the acidic waste liquid and the cathode liquid may be allowed to pass in opposite directions with the cation exchange membrane 5 provided therebetween. Heat exchange can also be performed between the eluent charged into the eluting bath 8 and the acid waste liquid discharged therefrom.

EXAMPLES OF FIRST INVENTION

Hereinafter, with reference to examples, the first invention will be described in more detail.

(1) Electrodeposition of Waste Sulfuric Acid Liquid Containing Iron-Group Metals (Fe, Co)

1) Test Conditions

Example 1

A simulated acidic waste liquid having properties shown in Table 1 was prepared by dissolving $CoCl_2$, $FeCl_3$, and sulfuric acid in water. A simulated electrodeposition liquid (cathode liquid) having properties shown in Table 1 was prepared by dissolving citric acid in water. By the use of the apparatus shown in FIG. 1, an electrodeposition test of Co and Fe was performed. The electrodeposition conditions are as shown in Table 1. A Pt-plated Ti plate was used as the anode, and a Cu plate was used as the cathode. Co and Fe in the simulated acidic waste liquid after a 6-hour voltage application were measured by an atomic absorption photometer.

Comparative Examples 1 and 2

After 400 mL of a simulated acidic waste liquid having properties shown in Table 2 was prepared and then received in a 500-mL beaker, a cathode (Cu plate) and an anode (Pt-plated Ti plate) were inserted therein, and the voltage was applied therebetween. No cation exchange membrane was used. The electrodeposition conditions are as shown in Table 2. Co and Fe in the simulated acidic waste liquid after a voltage application for 6 hours were measured by an atomic absorption photometer.

TABLE 1

<Conditions of Example 1>

| | | Example 1 |
|---|---|---|
| Current [A] | | 0.4 |
| Current Density [mA/cm$^2$] | | 47.6 |
| Electrode Area, Membrane Area [cm$^{2-}$] | | 8.4 |
| Anode Chamber Volume, Cathode Chamber Volume [mL] | | 10.1 |
| Simulated Acidic Waste Liquid | Composition | Sulfuric Acid: 10 wt %<br>$CoCl_2$: 500 mg-Co/L<br>$FeCl_3$: 500 mg-Fe/L |
| | Volume [mL] | 100 mL |
| | pH | <0 |
| | Anode Chamber SV [hr$^{-1}$] | 4 |
| Simulated Electrodeposition Liquid | Composition | Citric Acid: 3.4 g/L |
| | Volume [mL] | 500 |
| | pH | 2.5 |
| | Cathode Chamber SV [hr$^{-1}$] | 30 |
| Voltage Application Time [hr] | | 6 |

TABLE 2

<Conditions of Comparative Examples 1 and 2>

| | | Comparative Example 1 | Comparative Example 2 |
|---|---|---|---|
| Current [A] | | 1.0 | |
| Current Density [mA/cm$^2$] | | 62.5 | |
| Electrode Area [cm$^{2-}$] | | 16 | |
| Simulated Acidic Waste Liquid | Composition | Sulfuric Acid: 10 wt %<br>$CoCl_2$: 100 mg-Co/L<br>$FeCl_3$: 100 mg-Fe/L | Sulfuric Acid: 10 wt %<br>Citric Acid: 3.35 g/L<br>$CoCl_2$: 100 mg-Co/L<br>$FeCl_3$: 100 mg-Fe/L |
| | Volume [mL] | 400 mL | |
| | pH | <0 | |
| Voltage Application Time [hr] | | 6 | |

2) Results

In Example 1, by the voltage application for 6 hours, 19% of Co and 10% of Fe in the simulated acidic waste liquid could be removed, and a black electrodeposition material was obtained on the cathode. In Comparative Examples 1 and 2, the removal rate of Co and Fe in the liquid was 0% even after the voltage application for 6 hours, and no electrodeposition material was observed on the cathode. From Example 1 and Comparative Examples 1 and 2, it is found that a method in which, without direct contact of the acidic waste liquid with the cathode, metal ions are moved into the cathode chamber through the cation exchange membrane and are electrodeposited is effective.

(2) Electrodeposition of Co and Fe in Presence of Dicarboxylic Acid or Tricarboxylic Acid 1) Test Conditions By the use of $CoCl_2$, $FeCl_3$, and the additive shown in Table 3, liquids each in a volume of 400 mL having the compositions shown in Table 3 were prepared, and a liquid in which no suspended material was generated was subjected to an electrodeposition test similar to that of Comparative Example 1. The voltage application was performed for 8 hours.

2) Results

In Table 3, the presence or the absence of the generation of a suspended material and the pH of the liquid before and after the voltage application are shown in Table 3.

Figure 3:
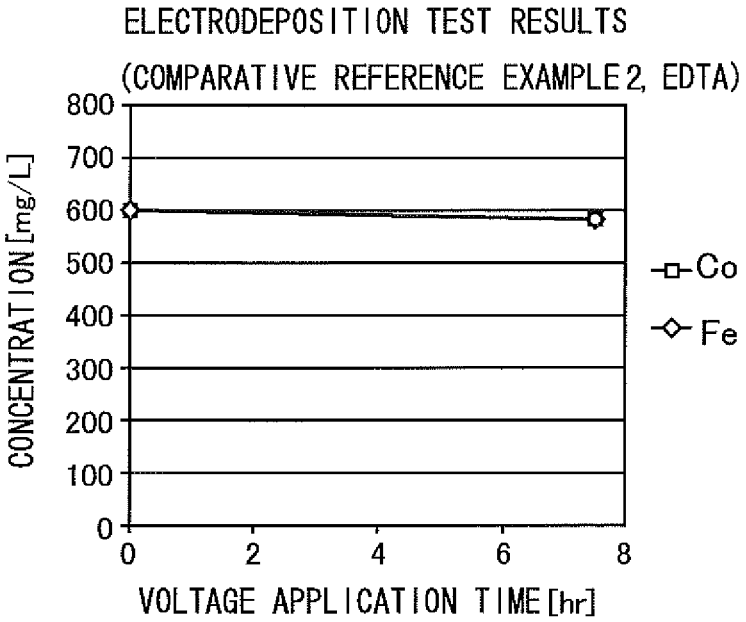
FIG. 3 is a graph showing electrodeposition results of Comparative Reference Example 2.
Figure 4:
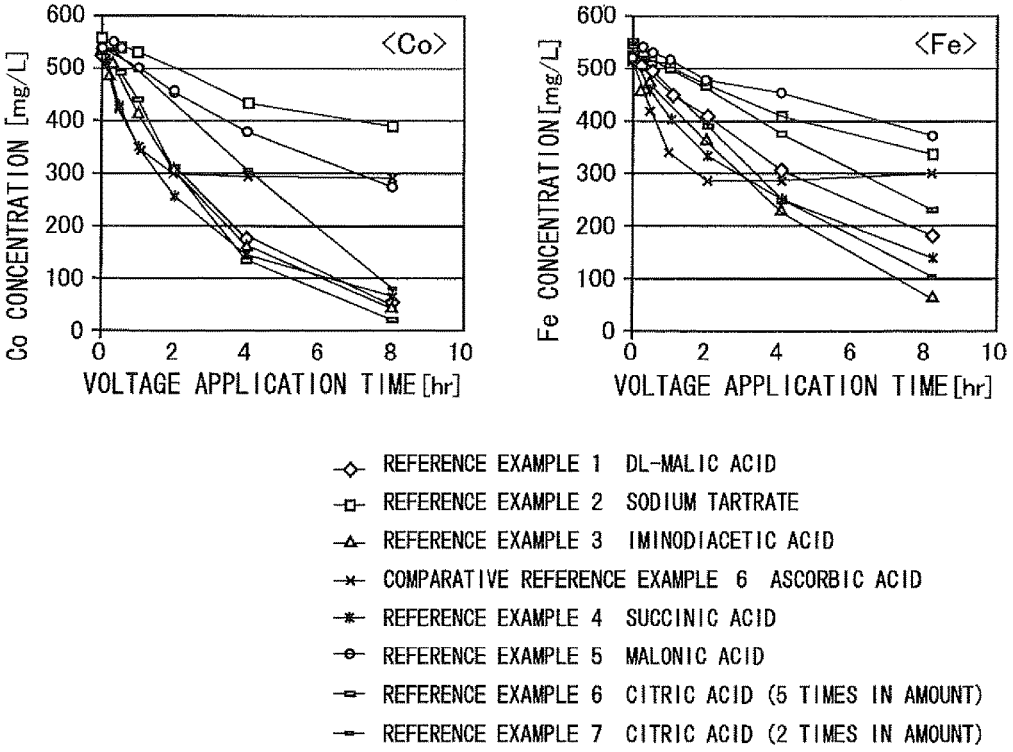
FIG. 4 is a graph showing electrodeposition results of Reference Examples 1 to 7 and Comparative Reference Example 6.

As for Reference Examples 1 to 7 and Comparative Reference Examples 2 and 6 in each of which no suspended material was generated both before and after the voltage application, the results of analysis of the change in concentration of Co and Fe in the liquid with time are shown in FIGS. 3 and 4. From the results obtained by the voltage application for 8 hours, it is found that in Reference Examples 1 to 7, Co and Fe can be simultaneously electrodeposited with time.

TABLE 3

<Electrodeposition Liquid Conditions and Confirmation Results of Suspended Material>

| | Composition of Electrodeposition Liquid | | | | Before Voltage Application | | After 8-Hour Voltage Application | |
|---|---|---|---|---|---|---|---|---|
| | Additive | | | | | | | |
| | Type | Addition Amount [※] | $CoCl_2$ [mg-Co/L] | $FeCl_3$ [mg-Fe/L] | pH | Suspended Material | pH | Suspended Material |
| Comparative Reference Example 1 | None | — | 500 | 500 | 2.4 | ○None | 1.9 | xYes |
| Comparative Reference Example 2 | Sodium Ethylenediaminetetraacetate | 20 | | | 8.6 | ○None | — | ○None |
| Comparative Reference Example 3 | Oxalic Acid | 5 | | | 1.34 | xYes | — | — |
| Comparative Reference Example 4 | Ethylenediamine | 5 | | | 10.1 | xYes | — | — |
| Reference Example 1 | DL-Malic Acid | 5 | | | 1.7 | ○None | 1.8 | ○None |
| Comparative Reference Example 5 | Tannic Acid | 0.5 | | | 1.8 | ○None | 1.7 | xYes |
| Reference Example 2 | Sodium Tartrate | 5 | | | 4.5 | ○None | 9.1 | ○None |
| Reference Example 3 | Iminodiacetic Acid | 5 | | | 1.9 | ○None | 1.9 | ○None |
| Comparative Reference Example 6 | Ascorbic Acid | 5 | | | 1.9 | ○None | 1.4 | ○None |
| Reference Example 4 | Succinic Acid | 5 | | | 1.7 | ○None | 1.6 | ○None |
| Reference Example 5 | Malonic Acid | 5 | | | 1.5 | ○None | 1.5 | ○None |
| Comparative Reference Example 7 | Gallic Acid | 2 | | | 1.8 | xYes | 1.6 | xYes |
| Comparative Reference Example 8 | Glycine | 5 | | | 2.9 | ○None | 2.2 | xYes |
| Reference Example 6 | Citric Acid Monohydrate | 5 | | | 1.5 | ○None | 1.3 | ○None |
| Reference Example 7 | Citric Acid Monohydrate | 2 | | | 1.5 | ○None | 1.7 | ○None |

[※] Molar Amount Ratio (indicating the ratio of the molar amount to the total molar amount of Co and Fe.)

(3) Continuous Electrodeposition Test

If the electrodeposition can be successively performed, the electrodeposition amount per unit electrode area can be increased, and the reduction in amount of a waste can be performed. Hence, it was confirmed whether long-hour continuous electrodeposition could be performed or not while Co and Fe were replenished.

1) Test Method

By the use of $CoCl_2$, $FeCl_3$, and citric acid, after 400 ml of a liquid containing 100 mg-Co/L, 100 mg-Fe/L, and 3,350 mg/L of citric acid (5 times in molar amount with respect to the total molar amount of Co and Fe) and having a pH of 2.2 was prepared in a 500-mL beaker, an electrodeposition test under conditions similar to those of Comparative Example 1 was started, and solid chlorides of Co and Fe in amounts each corresponding to 50 mg/L were additionally added every 2 hours, so that a long-hour electrodeposition test was performed.

2) Results and Discussion

Figure 5:
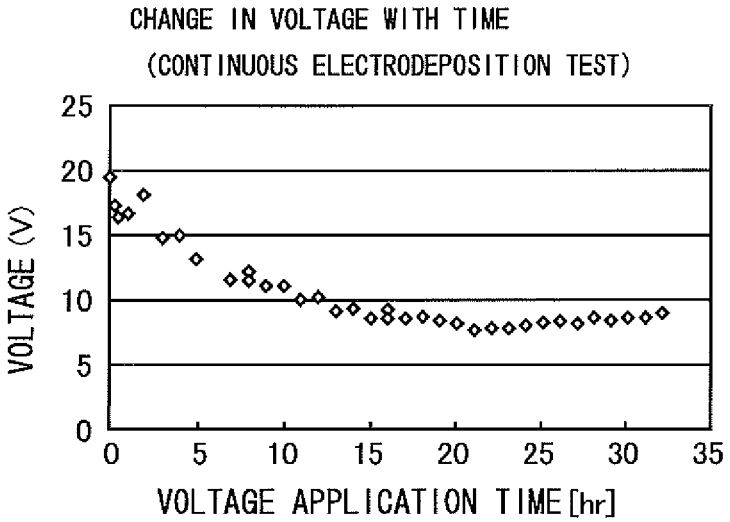
FIG. 5 is a graph showing the change in voltage with time in a long-hour continuous electrodeposition test.

By the voltage application, a black electrodeposition material was adhered to the cathode. From FIG. 5 showing the change in voltage with time during the continuous test, it is found that although the voltage application is continued, the voltage is not increased, and the precipitate on the cathode is electrically conductive. By this test, it was found that an electrodeposition treatment could be stably performed for long hours.

[Embodiment of Second Invention]

Hereinafter, an embodiment of the second invention will be described in detail.

In the second invention, at least one type of additive which is used to improve the electrodeposition efficiency and which is selected from a dicarboxylic acid and a salt thereof and a tricarboxylic acid and a salt thereof, each of which has a specific structure and, will be described.

In the second invention, as the additive, a compound selected from a dicarboxylic acid having 2 carboxylic groups in its molecule and a salt thereof (hereinafter, referred to as "dicarboxylic acid (salt)" in some cases) and a tricarboxylic acid having 3 carboxylic groups in its molecule and a salt thereof (hereinafter, referred to as "tricarboxylic acid (salt)" in some cases) is used. Those compounds may be used alone, or at least two types thereof may be used by mixing. The dicarboxylic acid (salt) and the tricarboxylic acid (salt) each suppress the generation of a suspended material during an electrodeposition treatment by the chelating effect thereof and have an excellent effect of improving the electrodeposition effect.

On the other hand, a monocarboxylic acid having 1 carboxylic group in its molecule has a weak bonding force to Co ions and Fe ions, and problems in that suspended materials formed from hydroxides of Co and Fe are generated in the liquid and/or electrodeposition is not uniformly performed on the cathode may occur. When a carboxylic acid having at least 4 carboxylic groups in its molecule is used, a bonding force to Co ions and Fe ions is excessively high, Co and Fe are held in the liquid, and a problem in that the electrodeposition rate is seriously decreased may arise.

In the second invention, as the dicarboxylic acid (salt) or the tricarboxylic acid (salt), by the use of the compound having a specific structure represented by the above formula (1), a suspended material is not likely to be generated during the electrodeposition treatment, and in addition, the electrodeposition is rapidly advanced. In the dicarboxylic acid (salt) and the tricarboxylic acid (salt) each represented by the above formula (1), 1 to 3 carbon atoms are present between the intramolecular carboxyl groups which are most distant from each other, and because of the shape thereof, it is estimated that an appropriate bonding force to Co ions and Fe ions is obtained.

The dicarboxylic acid (salt) and the tricarboxylic acid (salt) preferable for the second invention are the same as the dicarboxylic acid (salt) and the tricarboxylic acid (salt) preferable for the first invention.

In the second invention, the dicarboxylic acid (salt) and/or the tricarboxylic acid (salt) is preferably present with an ammonium salt. In the case in which no ammonium salt is added, in general, the electrodeposition rate of Co is faster than that of Fe, and an Fe electrodeposition layer is formed on a Co electrodeposition layer; however, when the ammonium salt is added, the electrodeposition rate of Co becomes approximately equivalent to that of Fe, and Co and Fe are electrodeposited so as to form an alloy. When the electrodeposition rate of Co is different from that of Fe, and a Co layer and an Fe layer are separately electrodeposited, because of the difference in physical properties between Co and Fe, floating and/or peeling of an electrodeposition material is liable to occur, and as a result, a successive electrodeposition treatment may not be performed in some cases.

A preferable ammonium salt is the same as the ammonium salt preferable in the first invention.

An ammonium citrate includes monoammonium citrate, diammonium citrate, and triammonium citrate, and although all of them may be preferably used, since the amount of ammonium is large in the compound, triammonium citrate is preferably used.

Figure 6:
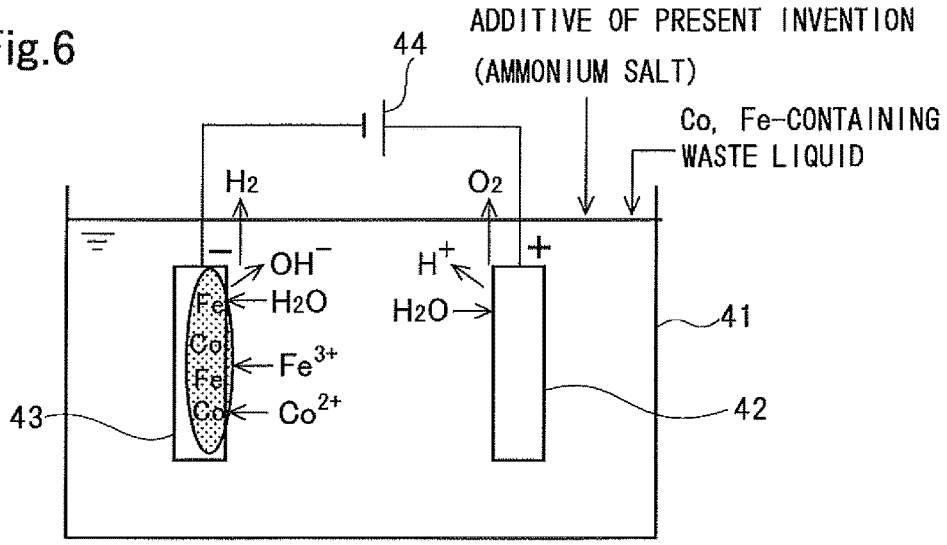
FIG. 6 is a systematic diagram of an electrodeposition apparatus sowing one example of the embodiment.

In order to perform electrodeposition by the second invention, for example, as shown in FIG. 6, after a waste liquid (Co, Fe-containing waste liquid) containing Co ions and Fe ions is charged into an electrodeposition bath 41, and at the same time, the additive described above is added with or without an ammonium salt to the waste liquid and is then mixed therewith, and the voltage is applied between an anode 42 and a cathode 43 inserted in the liquid by a power source 44, so that Co and Fe are simultaneously electrodeposited on the cathode 43.

By the use of the above electrodeposition apparatus shown in FIG. 1 in which the cation exchange membrane is provided in the electrodeposition bath, a more preferable electrodeposition treatment can be performed. In the above electrodeposition apparatus shown in FIG. 1, the anode chamber 2A provided with the anode 2 of the electrodeposition bath 1 and the cathode chamber 3A provided with the cathode 3 thereof are separated from each other by the cation exchange membrane 5, the waste liquid (Co, Fe-containing waste liquid) containing Co ions and Fe ions is allowed to pass through the anode chamber 2A, an electrodeposition liquid containing the additive described above with or without an ammonium salt is allowed to pass through the cathode chamber 3A, and the voltage is applied between the anode 2 and the cathode 3, so that Co ions and Fe ions in the liquid in the anode chamber 2A are moved into the liquid in the cathode chamber 3A through the cation exchange membrane 5, and Co and Fe are precipitated on the cathode 3.

In the case in which the electrodeposition apparatus shown in FIG. 1 is used for the second invention, reference numeral 10 indicates a Co, Fe-containing waste liquid storage bath, and a circulation system is formed so that the Co, Fe-containing waste liquid is charged into the anode chamber 2A by the pump $P_1$ through the pipe 11, and the discharged liquid is returned to the Co, Fe-containing waste liquid storage bath 10 through the pipe 12. Reference numeral 20 indicates an electrodeposition liquid storage bath containing the additive described above with or without an ammonium salt, and a circulation system is formed so that the electrodeposition liquid is charged into the cathode chamber 3A by the pump $P_2$ through the pipe 21, and the discharged liquid is returned to the electrodeposition liquid storage bath 20 through the pipe 22.

In the second invention, the pH of the liquid into which the cathode is immersed is set to preferably 1 to 9 and more preferably 2 to 8.5. When the pH is excessively low, re-dissolution of Co and Fe electrodeposited on the cathode occurs, and the electrodeposition rate may be decreased in some cases. When the pH is excessively high, hydroxides of Co and Fe are liable to be generated as suspended materials in the liquid. When the pH is out of the range described above, an appropriate pH adjustment is preferably performed using an alkali or an acid.

In the apparatus shown in FIG. 6, in the case in which the waste liquid is a strong-acid liquid having a pH of 1 or less, unless otherwise the pH is adjusted by addition of an alkali, a problem in that Co and Fe electrodeposited on the cathode 43 are re-dissolved, or no electrodeposition itself occurs may arise. On the other hand, in the apparatus shown in FIG. 1 in which the cation exchange membrane 5 is provided, as long as the electrodeposition liquid at the cathode 3 side is placed under conditions suitable for the electrodeposition, even if the waste liquid is a strong-acid liquid, Co and Fe can be removed by electrodeposition without causing any problems. In the case in which a strong-acid waste liquid is reused after Co ions and Fe ions are removed therefrom, when the pH adjustment is once performed with an alkali, the reuse as an strong-acid liquid becomes difficult; however, according to the apparatus shown in FIG. 1, without decreasing the acidity of the waste liquid, Co ions and Fe ions can be removed from the waste liquid through the cation exchange membrane, so that a treated liquid can be reused.

Although the dicarboxylic acid (salt) and the tricarboxylic acid (salt), each of which functions as the additive, are each decomposed by an oxidation reaction at the anode when being brought into contact with the anode, in the apparatus shown in FIG. 1 in which the cation exchange membrane 5 is provided, since the electrodeposition liquid containing the dicarboxylic acid (salt) or the tricarboxylic acid (salt) at the cathode side is not brought into contact with the anode, the dicarboxylic acid (salt) and the tricarboxylic acid (salt) can be prevented from being consumed by oxidation.

In the apparatus shown in FIG. 1, although the electrodeposition bath 1 is a closed system, an open system in which the upper portion is opened as shown in FIG. 6 may also be used. In the electrodeposition bath 1, since a hydrogen gas is generated from the cathode, an open system in which the upper portion is opened is preferable. When the cathode on which Co and Fe are electrodeposited is changed, the change thereof can be easily performed in the system in which the upper portion of the electrodeposition bath is opened.

In both the electrodeposition apparatuses shown in FIGS. 6 and 1, in order to improve the electrodeposition efficiency, besides the use of an appropriate amount of the additive described above, furthermore, an ammonium salt is preferably used. In the apparatus shown in FIG. 6, with respect to the total molar amount of Co and Fe in the liquid in the electrodeposition bath at the start of the electrodeposition, the additive described above is preferably added so that the amount thereof is 0.1 to 50 molar times and particularly 0.5 to 10 molar times.

In the case of the electrodeposition apparatus shown in FIG. 1, with respect to the total molar concentration of Co and Fe in the Co, Fe-containing waste liquid to be charged into the anode chamber, the molar concentration of the additive described above in the electrodeposition liquid to be charged into the cathode chamber is preferably 0.1 to 50 times and particularly preferably 0.5 to 10 times. As the electrodeposition liquid, for example, an aqueous solution containing 0.01 to 20 percent by weight of the above additive and preferably 0.1 to 5 percent by weight thereof and having a pH of 1 to 9 and preferably 2 to 8.5 is used.

In both the cases described above, when the amount of the additive described above is excessively small, the effect of suppressing a suspended material obtained by the use of the additive cannot be sufficiently obtained, and when the amount is excessively large, since the chelating effect is excessively enhanced, the electrodeposition rate is decreased.

In the case in which the ammonium salt is used, the ammonium salt is preferably used in an amount so that the concentration thereof in the liquid (electrodeposition liquid in the structure shown in FIG. 1) in the electrodeposition bath is 0.01 to 20 percent by weigh and preferably 0.1 to 5 percent by weight. When the concentration of the ammonium salt is excessively low, the above effect obtained by the use of the ammonium salt cannot be sufficiently obtained, and when the concentration is excessively high, the effect is not improved, and the consumption amount of the chemical agent is increased.

In the case in which the additive described above and the ammonium salt are formed into one component type and then added, the addition may be performed so that a preferable addition amount range of the additive described above and a preferable addition amount range of the ammonium salt are simultaneously satisfied.

Although the electrodeposition conditions (such as the current, the current density, and the temperature) are not particularly limited, the current density is preferably set to 5 to 600 mA/cm$^2$ with respect to the cathode area in terms of the electrodeposition efficiency.

The Co ion concentration and the Fe ion concentration in the liquid containing Co ions and Fe ions on which the electrodeposition treatment is performed in the second invention are not particularly limited. The second invention may be applied, for example, to a liquid containing Co ions at 0.1 to 5,000 mg-Co/L, Fe ions at 0.1 to 10,000 mg-Fe/L, and a total thereof at 0.2 to 15,000 mg/L. The second invention is preferably used for the treatment of a waste liquid containing radioactive Co ions and Fe ions generated from a nuclear power plant or the like, such as a decontamination waste liquid generated in a nuclear power plant or an eluent eluting metal ions from an ion exchange resin used in a nuclear power plant. Those waste liquids frequently contain metal ions, such as radioactive Ni ions, other than radioactive Co ions and Fe ions, and even in the case in which those metal ions are contained, an electrodeposition treatment can be performed together with Co and Fe.

EXAMPLES OF SECOND INVENTION

Hereinafter, with reference to examples, the second invention will be described in more detail.

(1) Electrodeposition of Co and Fe in Presence of Dicarboxylic Acid or Tricarboxylic Acid 1) Test Conditions By the use of various types of additives, $CoCl_2$, and $FeCl_3$, electrodeposition liquids each in a volume of 400 mL having the compositions shown in Table 4 were prepared, and a liquid which generated no suspended materials was subjected to an electrodeposition test using the apparatus shown in FIG. 6. The voltage application was performed at 1 A (current density: 62.5 mA/cm$^2$) for 8 hours. A Pt-plated Ti plate was used as the anode, and a Cu plate was used as the cathode.

2) Results

The presence or the absence of the generation of a suspended material and the pH of the liquid before and after the voltage application are shown in Table 4.

Figure 7:
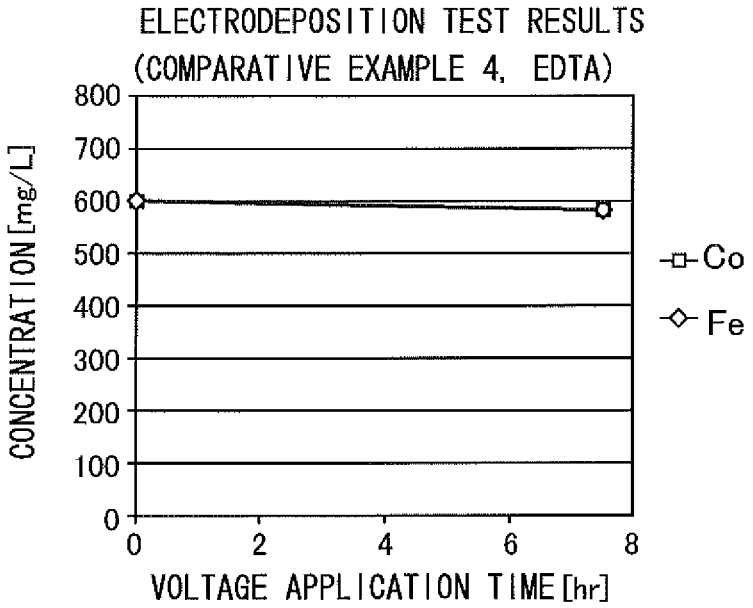
FIG. 7 is a graph showing electrodeposition results of Comparative Example 4.
Figure 8:
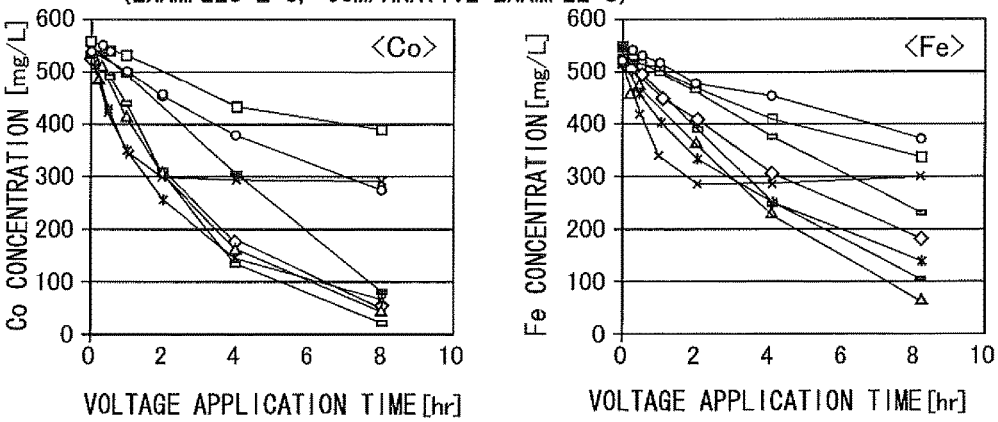
FIG. 8 includes graphs showing electrodeposition results of Examples 2 to 8 and Comparative Example 8.

As for the electrodeposition liquids of Examples 2 to 8 and Comparative Examples 4 and 8 in each of which no suspended material was observed both before and after the voltage application, the results of analysis of the change in concentration of Co and Fe in the liquid with time are shown in FIGS. 7 and 8. From the results of the voltage application for 8 hours, in Examples 2 to 8, it is found that Co and Fe can be electrodeposited with time.

TABLE 4

<Electrodeposition Liquid Conditions and Confirmation Results of Suspended Material>

| | Composition of Electrodeposition Liquid | | | | Before Voltage Application | | After 8-Hour Voltage Application | |
|---|---|---|---|---|---|---|---|---|
| | Additive | | | | | | | |
| | Type | Addition Amount [X] | $CoCl_2$ [mg-Co/L] | $FeCl_3$ [mg-Fe/L] | pH | Suspended Material | pH | Suspended Material |
| Comparative Example3 | None | — | 500 | 500 | 2.4 | ○None | 1.9 | xYes |
| Comparative Example4 | Sodium Ethylenediaminetetraacetate | 20 | | | 8.6 | ○None | — | ○None |
| Comparative Example5 | Oxalic Acid | 5 | | | 1.34 | xYes | — | — |
| Comparative Example6 | Ethylenediamine | 5 | | | 10.1 | xYes | — | — |
| Example2 | DL-Malic Acid | 5 | | | 1.7 | ○None | 1.8 | ○None |
| Comparative Example 7 | Tannic Acid | 0.5 | | | 1.8 | ○None | 1.7 | xYes |

TABLE 4-continued

<Electrodeposition Liquid Conditions and Confirmation Results of Suspended Material>

| | Composition of Electrodeposition Liquid | | | | | Before Voltage Application | | After 8-Hour Voltage Application | |
|---|---|---|---|---|---|---|---|---|---|
| | Additive | | | | | | | | |
| | Type | Addition Amount [※] | $CoCl_2$ [mg-Co/L] | $FeCl_3$ [mg-Fe/L] | | pH | Suspended Material | pH | Suspended Material |
| Example 3 | Sodium Tartrate | 5 | | | | 4.5 | ○None | 9.1 | ○None |
| Example 4 | Iminodiacetic Acid | 5 | | | | 1.9 | ○None | 1.9 | ○None |
| Comparative Example 8 | Ascorbic Acid | 5 | | | | 1.9 | ○None | 1.4 | ○None |
| Example 5 | Succinic Acid | 5 | | | | 1.7 | ○None | 1.6 | ○None |
| Example 6 | Malonic Acid | 5 | | | | 1.5 | ○None | 1.5 | ○None |
| Comparative Example 9 | Gallic Acid | 2 | | | | 1.8 | xYes | 1.6 | xYes |
| Comparative Example 10 | Glycine | 5 | | | | 2.9 | ○None | 2.2 | xYes |
| Example 7 | Citric Acid Monohydrate | 5 | | | | 1.5 | ○None | 1.3 | ○None |
| Example 8 | Citric Acid Monohydrate | 2 | | | | 1.5 | ○None | 1.7 | ○None |

[※] Molar Amount Ratio (indicating the ratio of the molar amount to the total molar amount of Co and Fe.)

(2) Electrodeposition of Co and Fe with Citric Acid

1) Test Method

By the use of the apparatus shown in FIG. 6, a voltage application test was performed under the conditions shown in Table 5. In a 500-mL beaker, the electrodeposition liquid was prepared in a volume of 400 mL using $CoCl_2$, $FeCl_3$, and citric acid so as to have the composition shown in Table 5. A Pt-plated Ti plate was used as the anode, and a Cu plate was used as the cathode.

TABLE 5

<Electrodeposition Test Conditions (Only Citric Acid))>

| | Composition of Electrodeposition Liquid | | | | | Electrodeposition Conditions | | | | |
|---|---|---|---|---|---|---|---|---|---|---|
| | $CoCl_2$ [mg-Co/L] | $FeCl_3$ [mg-Fe/L] | Citric Acid [※] | Citric Acid [mg/L] | pH | Voltage Application Time [hr] | Current [A] | Current Density [mA/cm$^2$] | Heating | Reaching Temperature [° C.] |
| Example 9 | 100 | 100 | 5 | 3,350 | 2.2 | 8 | 0.5 | 31.3 | None | 33 |
| Example 10 | | | | | | | 1 | 62.5 | None | 42 |
| Example 11 | | | | | | | 1.5 | 93.8 | None | 60 |
| Example 12 | | | | | | | 1 | 62.5 | Yes | 60 |

[※] Molar Amount Ratio (indicating the ratio of the molar amount to the total molar amount of Co and Fe.)

2) Results

Figure 9:
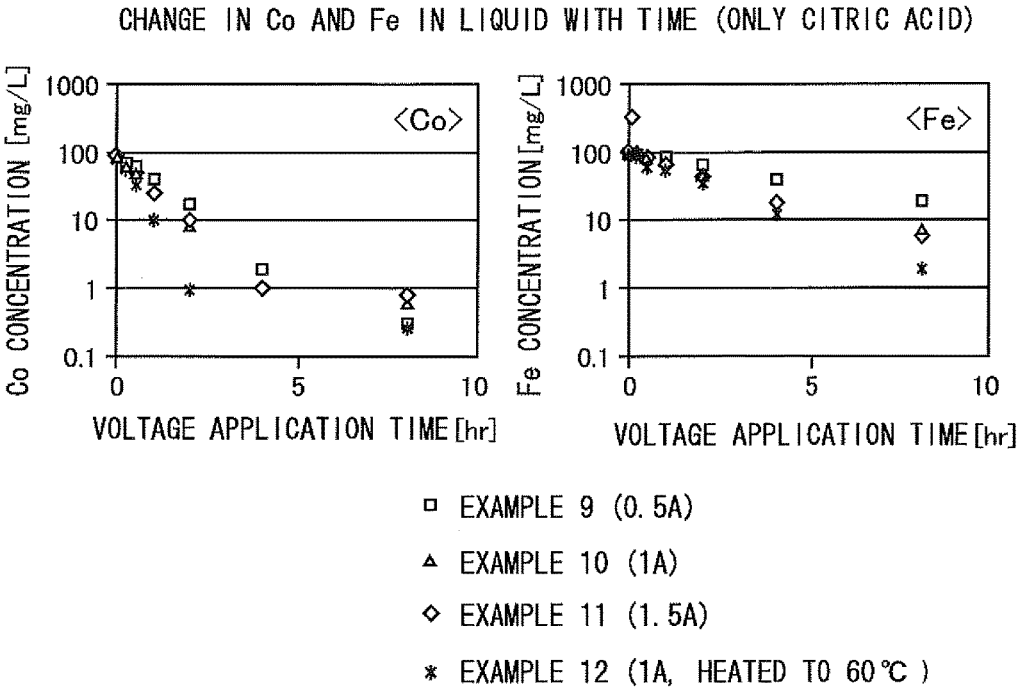
FIG. 9 is a graph showing electrodeposition results of Examples 9 to 12.

The electrodeposition results using only citric acid are shown in Table 6, and the change in concentration of Co and Fe in the liquid with time in the electrodeposition test is shown in FIG. 9. It is found that as for both Co and Fe, when the current density is increased, the electrodeposition rates of Co and Fe are increased.

TABLE 6

<Results of Electrodeposition Test (Only Citric Acid)>

| | | Current | Concentration before Voltage Application | | Concentration after Voltage Application (after 8 Hours) | | Removal Rate | |
|---|---|---|---|---|---|---|---|---|
| Test No. | Current [A] | Density [mA/cm$^2$] | Co [mg/L] | Fe [mg/L] | Co [mg/L] | Fe [mg/L] | Co [%] | Fe [%] |
| Example 9 | 0.5 | 31.3 | 101 | 100 | 2.0 | 41.5 | 98.0 | 58.6 |
| Example 10 | 1.0 | 62.5 | 104 | 111 | 0.67 | 7.4 | 99.4 | 93.3 |

TABLE 6-continued

<Results of Electrodeposition Test (Only Citric Acid)>

| Test No. | Current [A] | Current Density [mA/cm$^2$] | Concentration before Voltage Application Co [mg/L] | Concentration before Voltage Application Fe [mg/L] | Concentration after Voltage Application (after 8 Hours) Co [mg/L] | Concentration after Voltage Application (after 8 Hours) Fe [mg/L] | Removal Rate Co [%] | Removal Rate Fe [%] |
|---|---|---|---|---|---|---|---|---|
| Example 11 | 1.5 | 93.8 | 103 | 102 | 0.85 | 5.7 | 99.2 | 94.4 |
| Example 12 | 1.0 | 62.5 | 102 | 101 | 0.29 | 2.0 | 99.7 | 98.0 |

(3) Continuous Electrodeposition Test

When the electrodeposition can be successively performed, the electrodeposition amount per electrode unit area can be increased, and the amount of wastes can be reduced. Hence, it was confirmed whether a long-hour continuous electrodeposition can be performed or not while Co and Fe are replenished.

1) Test Method

The electrodeposition test was started under the same conditions as those of Example 10 shown in Table 5, and while Co and Fe, each of which was a solid chloride in an amount corresponding to 50 mg/L, were additionally added every 2 hours, a long-hour electrodeposition test was performed. The other conditions were the same as those of Example 10.

2) Results and Discussion

Figure 10:
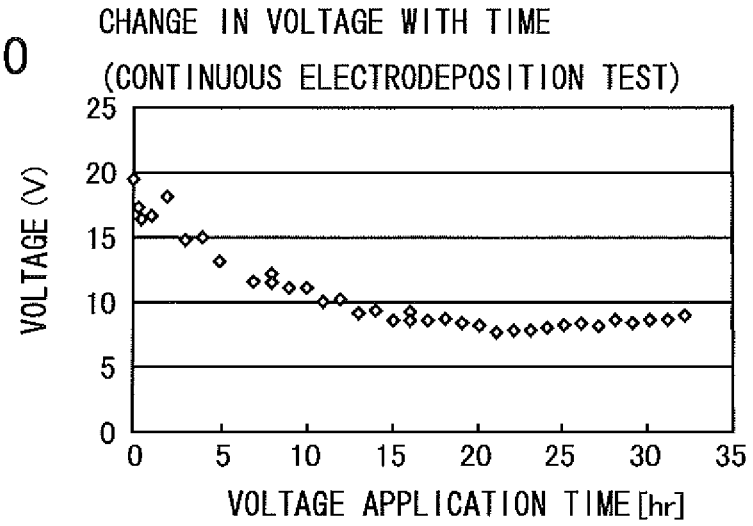
FIG. 10 is a graph showing the change in voltage with time in a long-hour continuous electrodeposition test using an electrodeposition liquid of Example 10.

By the voltage application, a black electrodeposition material was adhered to the cathode. From FIG. 10 showing the change in voltage with time during the continuous test, it is found that although the voltage application is continued, the voltage is not increased, and the precipitate on the cathode is electrically conductive. From this test, it was found that the electrodeposition treatment could be stably performed for long hours.

(4) Electrodeposition Test Using Both Citric Acid and Ammonium Salt or Using Ammonium Citrate 1) Test Method By the use of the apparatus shown in FIG. 6, the electrodeposition test was performed under the conditions shown in Tables 7A and 7B.

In Examples 13 to 17, by the use of $CoCl_2$, $FeCl_3$, and citric acid and/or an ammonium salt shown in FIG. 7A, 400 mL of an electrodeposition liquid was prepared in a 500-mL beaker, and a Pt-plated Ti plate and a Cu plate were used as the anode and the cathode, respectively. In Examples 18 to 21, by the use of $CoSO_4$, $Fe_2(SO_4)_3$, and ammonium citrate in the amounts shown in Table 7B, 400 mL of an electrodeposition liquid was prepared in a 500-mL beaker, and a Pt-plated Ti plate and a Cu plate were used as the anode and the cathode, respectively. For comparison, the electrodeposition conditions (Examples 10 and 11 shown in Table 5) using only citric acid are also shown in Table 7A.

TABLE 7A

Confirmation Test of Effect of Ammonium Salt

| | Composition of Electrodeposition Liquid | | | | | | | Electrodeposition Conditions | | | |
|---|---|---|---|---|---|---|---|---|---|---|---|
| | | | | | Ammonium Salt | | | Voltage | | | |
| | $CoCl_2$ [mg-Co/L] | $FeCl_3$ [mg-Fe/L] | Citric Acid [※] | Citric Acid [mg/L] | Type | Addition Amount [g/L] | pH | Application Time [hr] | Current [A] | Current Density [mA/cm$^2$] | Heating |
| Example 10 | 100 | 100 | 5 | 3,350 | 0 | | 2.2 | 8 | 1 | 62.5 | None |
| Example 11 | | | | | | | | | 1.5 | 93.8 | |
| Example 13 | | | 5 | 3,350 | Ammonium Oxalate | 33.4 | 4.3 | | 2 | 125 | |
| Example 14 | | | | | Ammonium Chloride | 32.0 | 1.9 | | 1 | 62.5 | |
| Example 15 | | | | | | | | | 2 | 125 | |
| Example 16 | | | | | Ammonium Sulfate | 31.0 | 2.5 | | 1 | 62.5 | |
| Example 17 | | | 0 | 0 | Ammonium Oxalate | 33.4 | 6.4 | | 1 | 62.5 | |

[※] Molar Amount Ratio (indicating the ratio of the molar amount to the total molar amount of Co and Fe.)

TABLE 7B

Confirmation Test of Effect of Ammonium Citrate

| | Composition of Electrodeposition Liquid | | | | | Electrodeposition Conditions | | | |
|---|---|---|---|---|---|---|---|---|---|
| | | | Ammonium Citrate | | | Voltage | | | |
| | $CoSO_4$ [mg-Co/L] | $Fe_2(SO_4)_3$ [mg-Fe/L] | Type | Addition Amount [g/L] | pH | Application Time [hr] | Current [A] | Current Density [mA/cm$^2$] | Heating |
| Example 18 | 100 | 100 | Diammonium Citrate | 7.9 | 4.78 | 6 | 1 | 62.5 | None |
| Example 19 | | | Triammonium Citrate | 8.5 | 6.44 | | | | |
| Example 20 | | | | | 6.41 | | 2 | 125 | |
| Example 21 | | | | 17.0 | 6.46 | | 1 | 62.5 | |

Figure 11:
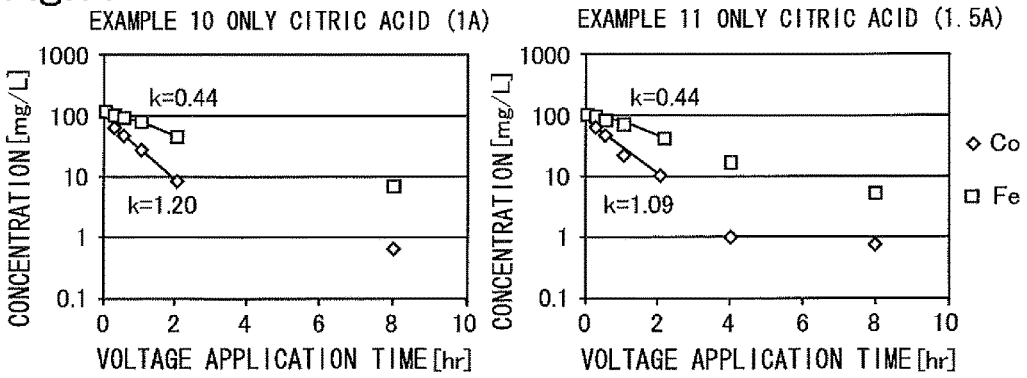
FIG. 11 is a graph showing electrodeposition results of Examples 10 and 11 in which only citric acid is used.
Figure 12:
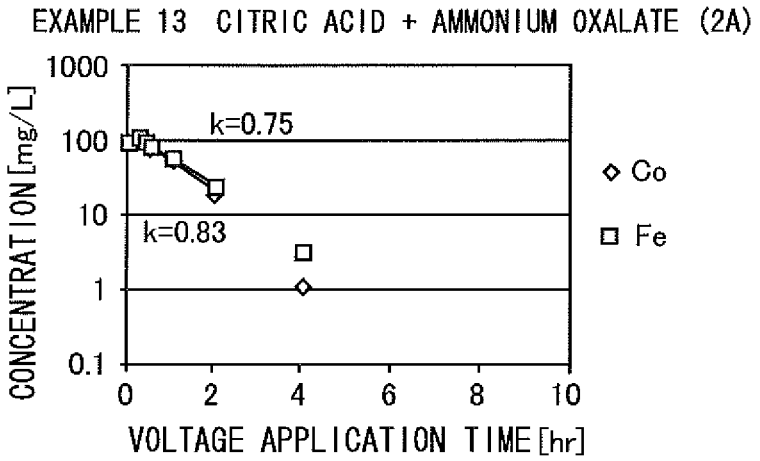
FIG. 12 is a graph showing electrodeposition results of Example 13 in which both citric acid and ammonium oxalate are used in combination.
Figure 13:
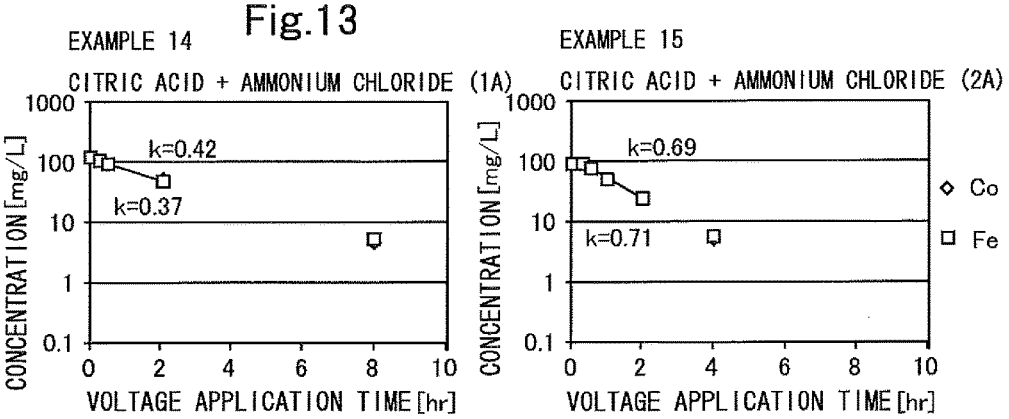
FIG. 13 is a graph showing electrodeposition results of Examples 14 and 15 in which both citric acid and ammonium chloride are used in combination.
Figure 14:
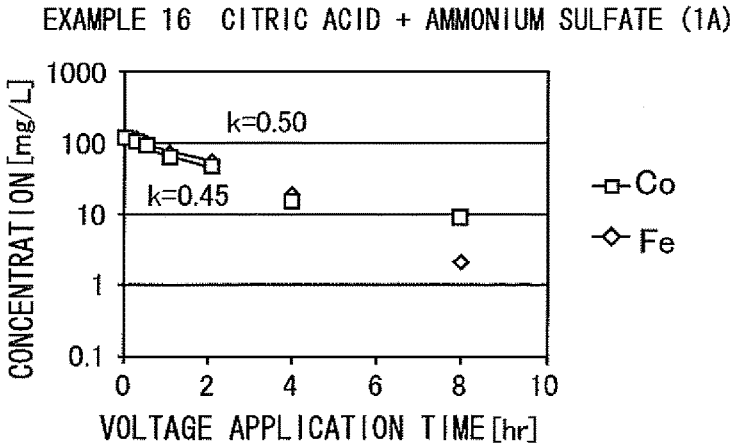
FIG. 14 is a graph showing electrodeposition results of Example 16 in which both citric acid and ammonium sulfate are used in combination.
Figure 15:
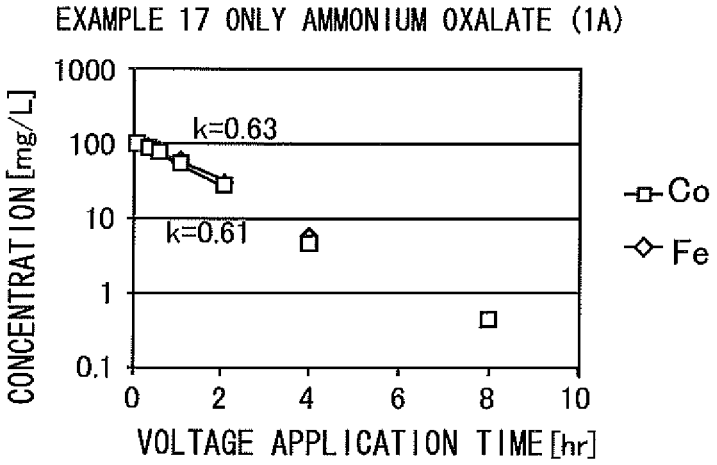
FIG. 15 is a graph showing electrodeposition results of Example 17 in which only ammonium oxalate is used.
Figure 16:
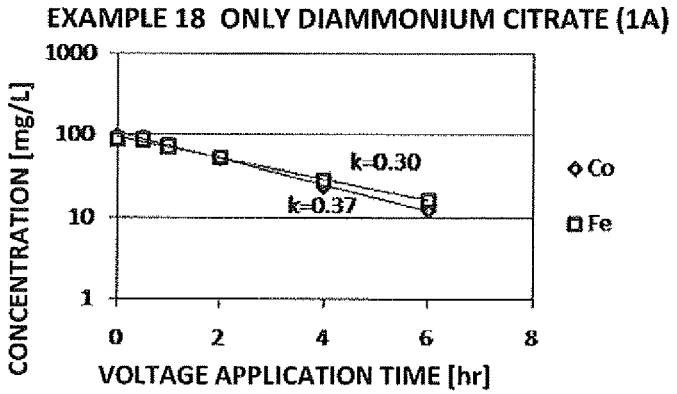
FIG. 16 is a graph showing electrodeposition results of Example 18 in which only diammonium citrate is used.
Figure 17:
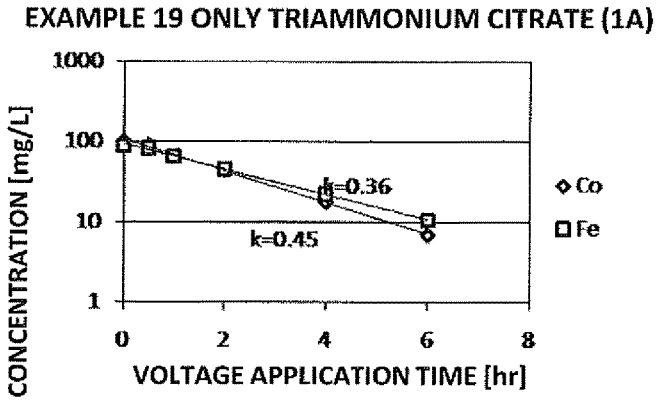
FIG. 17 is a graph showing electrodeposition results of Example 19 in which only triammonium citrate is used.
Figure 18:
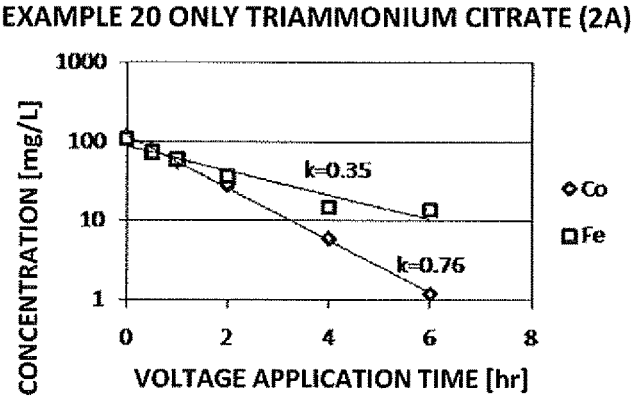
FIG. 18 is a graph showing electrodeposition results of Example 20 in which only triammonium citrate is used.
Figure 19:
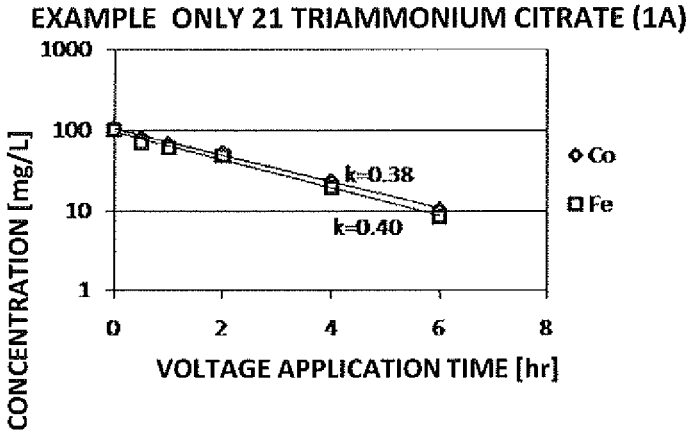
FIG. 19 is a graph showing electrodeposition results of Example 21 in which only triammonium citrate is used.

The results of the electrodeposition test using only citric acid (Examples 10 and 11) are shown in FIG. 11, the result of the electrodeposition using both citric acid and ammonium oxalate (Example 13) is shown in FIG. 12, the results of the electrodeposition using both citric acid and ammonium chloride (Examples 14 and 15) are shown in FIG. 13, and the results of the electrodeposition using both citric acid and ammonium sulfate (Example 16) are shown in FIG. 14. In FIG. 15, the results of the electrodeposition using only ammonium oxalate (Example 17) are shown.

The results of the electrodeposition tests of Examples 18 to 21, in each of which ammonium citrate was used, are shown in FIGS. 16 to 19, respectively.

In the drawings, "k" represents a reaction rate constant (proportional constant in the case in which the rate of decrease in concentration is proportional to the concentration), and a larger k represents a higher electrodeposition rate.

From FIG. 11, it is found that when citric acid is only used, although the electrodeposition rate of Co is high, the electrodeposition of Fe is slow. Hence, in the electrodeposition using only citric acid, it is believed that an Fe electrodeposition material is generated on a Co electrodeposition material.

In the systems in each of which the ammonium salt was added shown in FIGS. 12 to 15, it is found that electrodeposition of Co and that of Fe simultaneously occur. The reason for this is believed that since Co forms an ammine complex, the degree of stability of Co in the liquid is increased, and hence, Co is suppressed from being preferentially electrodeposited.

in the electrodeposition test using only ammonium oxalate shown in FIG. 15, by oxalic acid, which is a dicarboxylic acid, and ammonium ions, Co and Fe can both be rapidly electrodeposited by one component agent.

In the electrodeposition tests using only ammonium citrate shown in FIGS. 16 to 19, by citric acid, which is a tricarboxylic acid, and ammonium ions, Co and Fe can both be rapidly electrodeposited by one component agent. When the result obtained by diammonium citrate (FIG. 16) and the result obtained by triammonium citrate (FIG. 17) are compared to each other, it is found that the electrodeposition efficiency of Co and Fe using triammonium citrate, which has a larger ammonium amount, is higher.

(5) Confirmation of Permeation of Co and Fe Through Cation Exchange Membrane

In the case in which as the electrodeposition liquid, a citric acid aqueous solution was used, and as the eluent, a sulfuric acid aqueous solution was used, the permeation of Co and Fe through the cation exchange membrane by voltage application was confirmed.

1) Test Method

By the use of the electrodeposition apparatus shown in FIG. 1 in which the cation exchange membrane was provided, a voltage application test was performed (Example 22 and Example 23). The test conditions are shown in Table 8.

TABLE 8

| | | Example 22 | Example 23 |
|---|---|---|---|
| Current [A] | | 0.4 | 10 |
| Current Density [mA/cm$^2$] | | 47.6 | 125 |
| Electrode Area, Membrane Area [cm$^2$] | | 8.4 | 80 |
| Simulated Eluent (Co, Fe-Containing Waste Liquid) | Composition | Sulfuric Acid 10%<br>Co: 500 mg/L<br>Fe: 500 mg/L | Sulfuric Acid 5%<br>Co: 3 mg/L<br>Fe: 500 mg/L |
| | Volume [mL] | 100 | 400 |
| | SV [hr$^{-1}$] | 4 | 33 |
| Simulated Electrodeposition Liquid | Composition | 3.4 g/LCitric Acid<br>pH 2.5 | 17 g/LTriammonium Citrate<br>pH 6.4 |
| | Volume [mL] | 500 | 200 |
| | SV [hr$^{-1}$] | 30 | 33 |
| Voltage Application Time [hr] | | 17 | 16 |

2) Results and Discussion

Figure 20:
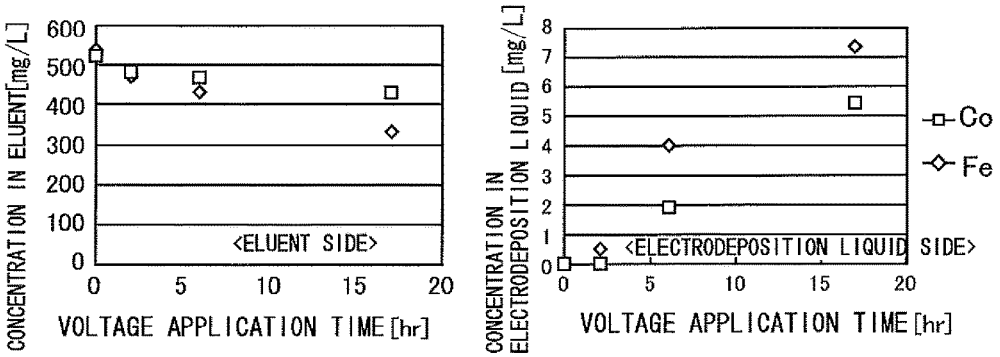
FIG. 20 is a graph showing permeation test results of a cation exchange membrane of Example 22.
Figure 21:
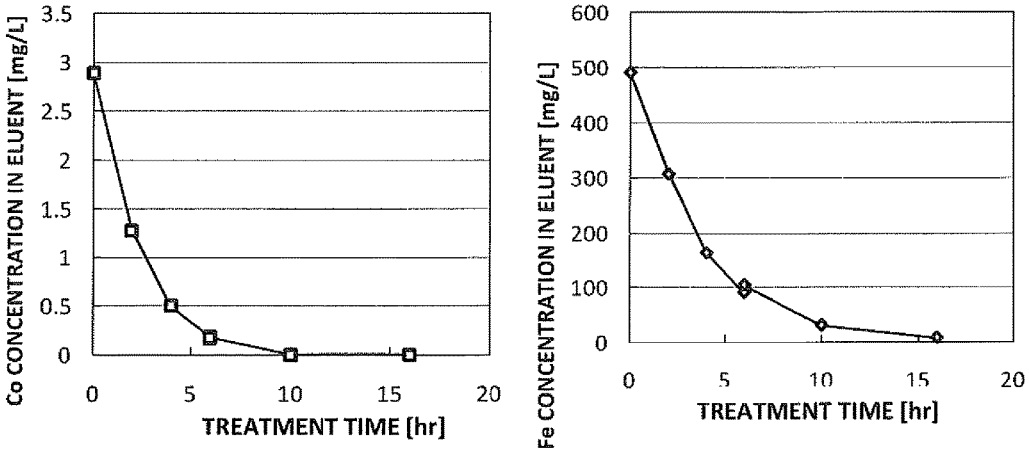
FIG. 21 includes graphs showing permeation test results (eluent) of a cation exchange membrane of Example 23.
Figure 22:
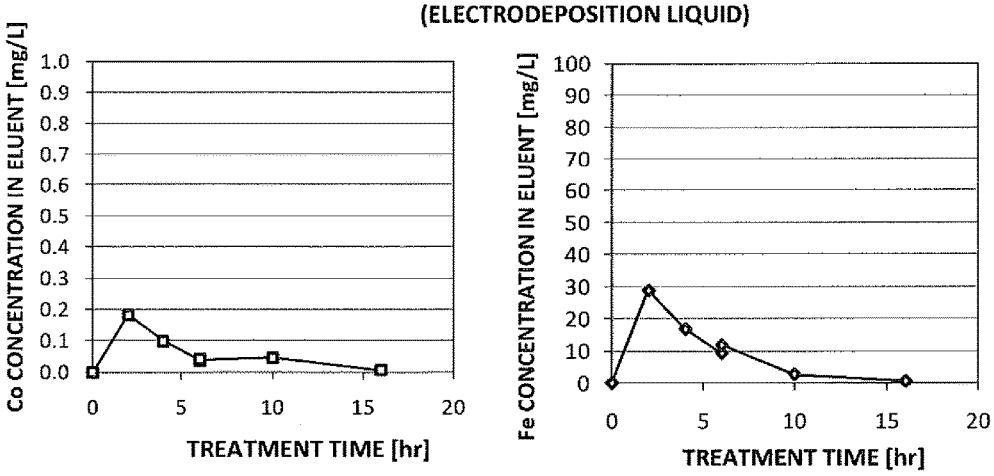
FIG. 22 is a graph showing permeation test results (electrodeposition liquid) of a cation exchange membrane of Example 23.

In FIG. 20, the change in concentration of Co and Fe with time at the eluent side and that at the electrodeposition liquid side in Examples 22 are shown. The change in concentration of Co and Fe with time at the eluent side and that at the electrodeposition liquid side of Example 23 are shown in FIGS. 21 and 22, respectively.

In both the cases, since the concentrations of Co and Fe are decreased at the eluent side and are increased at the electrodeposition liquid side, it is found that by the voltage application, Co ions and Fe ions permeate the cation exchange membrane. When the electrodeposition material on the cathode in each of Examples 22 and 23 was completely dissolved in a dissolution liquid in which a hydrochloric acid (mixture of 35% hydrochloric acid and purified water at a ratio of 1:1) and a nitric acid (mixture of 60% nitric acid and purified water at a ratio of 1:1) were mixed at a ratio of 2:3, and the electrodeposition amount was measured by an atomic absorption photometer, the measurement result coincided with the amount obtained by subtracting the increased amount of Co and Fe in the electrodeposition liquid from the decreased amount of Co and Fe in the eluent; hence, it was confirmed that Co ions and Fe ions in the eluent permeated the cation exchange membrane and were electrodeposited on the cathode.

[Embodiment of Third Invention]

Hereinafter, an embodiment of the third invention will be described in detail.

In the third invention, an acid (hereinafter, referred to as an eluent in some cases) heated to 60° C. or more is brought into contact with a waste ion exchange resin which adsorbs radioactive substances and also contains a clad primarily formed of iron oxide, so that ionic radioactive substances in the waste ion exchange resin are removed by elution, and at the same time, the clad is also removed by dissolution.

In the third invention, the radioactive waste ion exchange resin to be processed by a decontamination treatment adsorbs radioactive substances, such as radioactive metal components including cobalt-60 and nickel-63, which are formed into cations in the eluent, and also contains a clad primarily formed of iron oxide. In this case, "primarily formed of iron oxide" indicates that 50 percent by weight or more of iron oxide is contained in the clad. The adsorption amount of the radioactive substances and the content of the clad of the waste ion exchange resin are not particularly limited.

As the eluent, an aqueous solution of an inorganic acid, such as sulfuric acid, hydrochloric acid, or nitric acid, or an organic acid, such as formic acid, acetic acid, or oxalic acid, may be used. Those acids may be used alone, or at least two types thereof may be used by mixing. Sulfuric acid and/or oxalic acid, each of which is not likely to be volatilized during heating at 60° C. or more and is not categorized as a hazardous material, is preferably used.

As for the acid concentration in the eluent, a preferable concentration is present in accordance with an acid to be used. The sulfuric acid concentration is preferably 5 to 40 percent by weight and more preferably 10 to 30 percent by weight. The oxalic acid concentration is preferably 0.1 to 40 percent by weight and more preferably 1 to 20 percent by weight. When the acid concentration is lower than the range described above, the dissolution efficiency of hematite ($\alpha$-$Fe_2O_3$) which is a primary component of the clad is decreased. That is, the clad is present so as to be mixed in the waste ion exchange resin or incorporated in the resin, and the primary component of the clad is poor soluble hematite, so that dissolution thereof is difficult by a low concentration acid. When the acid concentration in the eluent is high, the amount of hydrogen generated in the electrodeposition step performed at a latter stage becomes excessive, and the electrodeposition efficiency is decreased.

In the third invention, the eluent is preferably used by heating to 60° C. or more, preferably 70° C. to 120° C., and more preferably 80° C. to 100° C. When this temperature is excessively low, the dissolution efficiency of the clad is low, and when this temperature is excessively high, since evaporation of water and volatilization of the acid become excessive, it is not preferable from a handling point of view.

A contact method between the heated eluent and the waste ion exchange resin is not particularly limited, and there may be used either a batch method in which the waste ion exchange resin is charged into the eluent and stirred or a liquid flow method in which as shown in the above FIG. 2, the eluent is allowed to pass through the packed tower in which the waste ion exchange resin is packed.

In the case of the batch method, the contact time between the eluent and the waste ion exchange resin is preferably set to approximately 0.5 to 24 hours and is particularly preferably set to approximately 2 to 12 hours. In the case of the liquid flow method, a liquid passage SV is preferably set to approximately 0.2 to 10 $hour^{-1}$ with respect to the volume of the packed tower.

It is preferable that after an eluent (hereinafter, referred to as acidic waste liquid in some cases) which elutes ionic radioactive substances adsorbed to the waste ion exchange resin and dissolves the clad mixed therein by contact with the waste ion exchange resin and which contains those materials mentioned above is charged into an electrodeposition bath including an anode and a cathode, by voltage application between the anode and the cathode of the electrodeposition bath, cationic radioactive substances in the acidic waste liquid and iron ions derived from the clad are removed by electrodeposition thereof on the cathode, and a treated liquid thus obtained is reused as the eluent.

A preferable apparatus as an apparatus which performs a decontamination treatment of a waste ion exchange resin and an electrodeposition treatment of an acid waste liquid obtained by the decontamination treatment so as to reuse the acidic waste liquid is the above apparatus shown in FIG. 2.

The apparatus shown in FIG. 2 includes the eluent storage bath 30 storing an eluent, the eluting bath 8 which is a packed tower in which the waste ion exchange resin 40 is packed, the acid waste liquid storage bath 10 storing an acidic waste liquid to be discharged from the eluting bath 8, the electrodeposition bath 1 into which the acidic waste liquid from the acidic waste liquid storage bath 10 is charged, and the bath 20 storing an electrodeposition liquid (cathode liquid) to be supplied to the electrodeposition bath 1. The electrodeposition bath 1 has the structure in which the anode chamber 2A including the anode 2 and the cathode chamber 3A including the cathode 3 are separated from each other by the cation exchange membrane 5, the acidic waste liquid is allowed to pass through the anode chamber 2A, and the electrodeposition liquid (cathode liquid) is allowed to pass through the cathode chamber 3A. Reference numerals 9A and 9B each represent a heat exchanger. As long as the heat exchanger 9A can perform heating, and the heat exchanger 9B can perform cooling, any means may be used, and as the heat exchanger 9A, an electric heater may also be used.

The eluent in the eluent storage bath 30 is heated by the heat exchanger 9A to 60° C. or more while being transported to the eluting bath 8 by the pump $P_3$ through the pipe 31 and is then allowed to pass through the eluting bath 8 in an upward flow. An outflow liquid (acidic waste liquid) is subsequently cooled by the heat exchanger 9B to a temperature of less than 60° C., such as 10° C. to less than 60° C., at which the cation exchange membrane 5 in the electrodeposition bath 1 is not so much degraded, and is further transported to the acidic waste liquid storage bath 10 through the pipe 32. The acidic waste liquid in the acidic waste liquid storage bath 10 is charged into the anode chamber 2A of the electrodeposition bath 1 by the pump $P_1$ through the pipe 11, and an electrodeposition treated liquid is circulated to the eluent storage bath 30 through the pipe 34 and is reused as the eluent.

In addition, into the cathode chamber 3A of the electrodeposition bath 1, the electrodeposition liquid (cathode liquid) in the storage bath 20 is charged by the pump $P_2$ through the pipe 21 and is then returned to the storage bath 20 through the pipe 22.

An acid is appropriately replenished into the eluent storage bath 30 by the pipe 33, and into the storage bath 20, the electrodeposition liquid (cathode liquid) is appropriately replenished by the pipe 23.

In this apparatus, since the heated eluent is allowed to pass through the eluting bath 8 in which the waste ion exchange resin 40 is packed, ionic radioactive substances adsorbed to the waste ion exchange resin 40 are removed by elution, and in addition, the clad mixed in the waste ion exchange resin 40 or incorporated into resin particles is also removed by dissolution. After being brought into contact with the waste ion exchange resin 40, the eluent (acidic waste liquid) containing ionic radioactive substances and a dissolved material of the clad is charged into the anode chamber 2A of the electrodeposition bath (electrodeposition cell) 1 through the acidic waste liquid storage bath 10. When the voltage is applied between the anode 2 and the cathode 3 of the electrodeposition bath 1, radioactive metal ions and iron ions derived from the clad in the acidic waste liquid are moved into the cathode chamber 3A through the cation exchange membrane 5 and are then electrodeposited on the cathode 3. A treated liquid of the acid waste liquid from which the radioactive metal ions and the iron ions are removed in the electrodeposition bath 1 is returned to the eluent storage bath 30 and is recycled.

The electrodeposition liquid in the cathode chamber 3A is circulated by the pump $P_2$ through the storage bath 20 and is recycled while the electrodeposition liquid in an amount corresponding to the decrease thereof is added to the storage bath 20.

As the electrodeposition liquid (cathode liquid), an aqueous solution containing at least one type of additive selected from a dicarboxylic acid having 2 carboxylic groups in its molecule and a salt thereof (hereinafter, referred to as "dicarboxylic acid (salt)" in some cases) and a tricarboxylic acid having 3 carboxylic groups in its molecule and a salt thereof (hereinafter, referred to as "tricarboxylic acid (salt)" in some cases) is preferably used.

Those dicarboxylic acid (salt) and the tricarboxylic acid (salt) suppress the generation of a suspended material during electrodeposition by its chelating effect, and as a result, an effect of improving an electrodeposition effect can be obtained.

On the other hand, since a monocarboxylic acid having 1 carboxylic group in its molecule has a weak bonding force to radioactive metal ions (the radioactive substance is not limited at all to Co-60, and hereinafter, Co-60 and a stable Co isotope are collectively referred to as Co), such as Co-60, and Fe ions derived from the clad, problems in that suspended substances formed of hydroxides of Co and Fe are generated in the liquid and/or electrodeposition is not uniformly performed on the cathode may occur. When a carboxylic acid having at least 4 carboxylic groups in its molecule is used, since a bonding force to Co ions and Fe ions is excessively high, Co and Fe are held in the liquid, and as a result, a problem in that the electrodeposition rate is seriously decreased may occur.

As the dicarboxylic acid (salt) and the tricarboxylic acid (salt), a compound represented by the above formula (1) is preferable since a suspended material is not likely to be generated, and electrodeposition is rapidly advanced. In the dicarboxylic acid (salt) and the tricarboxylic acid (salt) each represented by the above formula (1), 1 to 3 carbon atoms are present between the intramolecular carboxylic groups, and because of the shape thereof, it is estimated that an appropriate bonding force to Co ions and Fe ions can be obtained.

The dicarboxylic acid (salt) and the tricarboxylic acid (salt) preferable for the third invention are the same as the dicarboxylic acid (salt) and the tricarboxylic acid (salt) preferable for the first invention.

In the electrodeposition liquid, the dicarboxylic acid (salt) and/or the tricarboxylic acid (salt) is preferably present with an ammonium salt. In the case in which the ammonium salt is not added, in general, the electrodeposition rate of Co is faster than that of Fe, and an Fe electrodeposition layer is formed on a Co electrodeposition layer; however, when the ammonium salt is added, the electrodeposition rate of Co becomes approximately equivalent to that of Fe, and Co and Fe are electrodeposited so as to form an alloy. When the electrodeposition rate of Co is different from that of Fe, and a Co layer and an Fe layer are separately electrodeposited, floating and/or peeling of an electrodeposition material is liable to occur, and as a result, a successive electrodeposition treatment may not be performed in some cases.

A preferable ammonium salt is the same as the preferable ammonium salt in the first invention.

The pH of the electrodeposition liquid is set to preferably 1 to 9 and more preferably 2 to 8.5. When the pH of the electrodeposition liquid is excessively low, re-dissolution of Co and Fe electrodeposited on the cathode occurs, and the electrodeposition rate may be decreased in some cases. When the pH of the electrodeposition liquid is excessively high, hydroxides of Co and Fe are liable to be generated as suspended materials in the liquid. When the pH of the electrodeposition liquid is out of the range described above, an appropriate pH adjustment is preferably performed using an alkali or an acid. As the acid to be used for the pH adjustment, the same dicarboxylic acid (salt) and/or tricarboxylic acid (salt) as the above additive in the electrodeposition liquid is preferably used.

As the electrodeposition liquid, for example, an aqueous solution containing 0.01 to 20 percent by weight of the additive described above and preferably 0.1 to 5 percent by weight thereof and having a pH of 1 to 9 and preferably 2 to 8.5 is used.

When the amount of the additive in the electrodeposition liquid is excessively small, the effect of suppressing a suspended material obtained by the use of the additive cannot be sufficiently obtained, and when the amount is excessively large, the chelating effect is excessively enhanced, and as a result, the electrodeposition rate is decreased.

In the case in which the ammonium salt is used, a concentration of the ammonium salt in the electrodeposition liquid is preferably 0.01 to 20 percent by weight and preferably 0.1 to 5 percent by weight. When the concentration of the ammonium salt of the electrodeposition liquid is excessively low, the above effect obtained by the use of the ammonium salt cannot be sufficiently obtained, and when the concentration is excessively high, the effect is not improved, and the consumption amount of the chemical agent is wasteful.

Although the electrodeposition conditions (such as the current, the current density, and the temperature) are not particularly limited, the current density is preferably set to 5 to 600 $mA/cm^2$ with respect to the cathode area in terms of the electrodeposition efficiency.

FIG. 2 shows one example of a decontamination apparatus preferable for the embodiment of the third invention, and the decontamination apparatus of the third invention is not limited at all to that shown in the drawing.

In FIG. 2, although being allowed to pass through the eluting bath 8 in an upward flow, the eluent may also be allowed to pass therethrough in a downward flow. In the case in which the waste ion exchange resin is a powder, the differential pressure is liable to increase when the liquid is allowed to pass therethrough, and hence the upward flow is preferable. In the electrodeposition bath 1, the acidic waste liquid and the electrodeposition liquid may be allowed to pass in opposite directions with the cation exchange membrane 5 provided therebetween. Heat exchange may also be performed between the eluent charged into the eluting bath 8 and the acid waste liquid discharged therefrom.

Although the electrodeposition bath 1 is a closed system, since a hydrogen gas is generated from the cathode, an open system in which an upper portion is opened is preferable. When a cathode on which a metal is electrodeposited is changed, the change thereof can be easily performed if the upper portion of the electrodeposition bath is opened.

In a nuclear power plant, the third invention can be effectively applied to a waste ion exchange resin which adsorbs ionic radioactive substances and which also contains a clad primarily formed of iron oxide, the waste ion exchange resin including a waste ion exchange resin used for cleanup of a cooling water system, such as a reactor water cleanup system or a fuel pool cooling cleanup system, which is directly brought into contact with a fuel rod and a waste ion exchange resin used for a treatment of a decontamination waste liquid discharged when radioactive substances are chemically removed from apparatuses and pipes of a primary cooling system contaminated by radioactive substances and from surfaces of metal members of the system including those mentioned above.

EXAMPLES OF THIRD INVENTION

Hereinafter, with reference to experimental examples and examples, the third invention will be described in more detail.

Experimental Example 1

An eluent (aqueous solution) having the acid concentration and the pH shown in Table 9 was prepared in a volume of 500 mL, and 1 g of a simulated clad (manufactured by Kojundo Chemical Laboratory Co., Ltd., $\alpha$-$Fe_2O_3$, diameter announced by the maker: 1 μm) was added into this eluent, so that a dissolution test was performed at the liquid temperature and for the dissolution time shown in Table 9.

From the Fe concentration in the eluent, the dissolution rate of Fe (clad) was investigated, and the results are shown in Table 9.

TABLE 9

| | Eluent | | | Dissolution Conditions | | Results | | | |
|---|---|---|---|---|---|---|---|---|---|
| | Acid | | | | | | Fe | | |
| No. | Type | Concentration (wt %) | pH | Temperature (° C.) | Dissolution Time (hr) | Fe Concentration in Eluent [mg/L] | Dissolution Rate [%] | Evaluation | Note |
| 1 | Sulfuric Acid | 5 | <0.5 | 90 | 4 | 1,200 | 85 | ○ | Example of |
| 2 | | 10 | <0.5 | | 2.5 | 1,400 | 100 | ○ | Third Invention |
| 3 | | 20 | <0.5 | | 1 | 1,400 | 100 | ○ | |
| 4 | Oxalic Acid | 9 | 0.60 | | 0.5 | 1,400 | 100 | ○ | |
| 5 | Sulfuric Acid + Oxalic Acid | 5 + 0.9 | <0.5 | | 2 | 1,400 | 100 | ○ | |
| 6 | Sulfuric Acid + Oxalic Acid | 5 + 0.09 | <0.5 | | 3 | 1,400 | 100 | ○ | |
| 7 | Sulfuric Acid | 1 | <1 | No Heating | 18 | 9 | 0.6 | x | Comparative |
| 8 | | 5 | <1 | | 18 | 63 | 4.5 | x | Example |
| 9 | | 10 | <1 | | 18 | 99 | 7.1 | x | |
| 10 | Hydrochloric Acid + Sulfuric Acid | 12 + 20 | <1 | | 18 | 800 | 57 | Δ | |
| 11 | Oxalic Acid | 9 | 0.60 | 40 | 18 | 11 | 0.8 | x | |
| 12 | Hydrazine | 3.2 | 10.9 | 40 | 18 | 0 | 0 | x | |

As apparent from Table 9, although the dissolution rate is low in Nos. 7 to 12 in which the dissolution test was performed at a low temperature, in Nos. 1 to 6 in which a sulfuric acid aqueous solution and/or an oxalic acid aqueous solution, each of which was heated to 90° C., was used, the clad can be efficiently dissolved.

Example 24

A mixed resin adsorbing Co was prepared in such a way that with an aqueous solution dissolving 96 mg of cobalt chloride (II) hexahydrate, 40.0 g of a powdered H-type cationic exchange resin (manufactured by Mitsubishi Chemical Co., Ltd., exchange capacity: 5.1 meq/g, grain size of 10 to 200 μm: 95%) and 40.0 g of a powdered OH-type anionic exchange resin (manufactured by Mitsubishi Chemical Co., Ltd., exchange capacity: 4.1 meq/g, grain size of 0 to 100 μm: 74%, 10 to 250 μm: 93%) were mixed and were then stirred for 12 hours. After 12 hours passed, since the result obtained by the measurement of the Co concentration in supernatant water using an atomic absorption photometer was the detection limit or less, it was confirmed that approximately all Co ions were adsorbed to the ion exchange resin. As a simulated clad, 4.0 g of an iron oxide (manufactured by Kojundo Chemical Laboratory Co., Ltd., $\alpha$-$Fe_2O_3$, diameter announced by the maker: 1 μm) was added to and mixed with the mixed resin described above, so that a simulated waste resin was prepared. Subsequently, after this simulated waste resin was charged into 1.6 L of a sulfuric acid eluent (aqueous solution) at a concentration 10 percent by weight heated to 90° C., the temperature was maintained at 90° C. while heating and stirring were performed, and the dissolution behavior was confirmed.

After the simulated waste resin was charged into the sulfuric acid eluent at a concentration of 10 percent by weight, several milliliters of the sulfuric acid eluent was sampled every predetermined time, so that Fe in the filtrated sample was analyzed by an atomic absorption photometer, and Co was also analyzed by ICP-MS.

Figure 23:
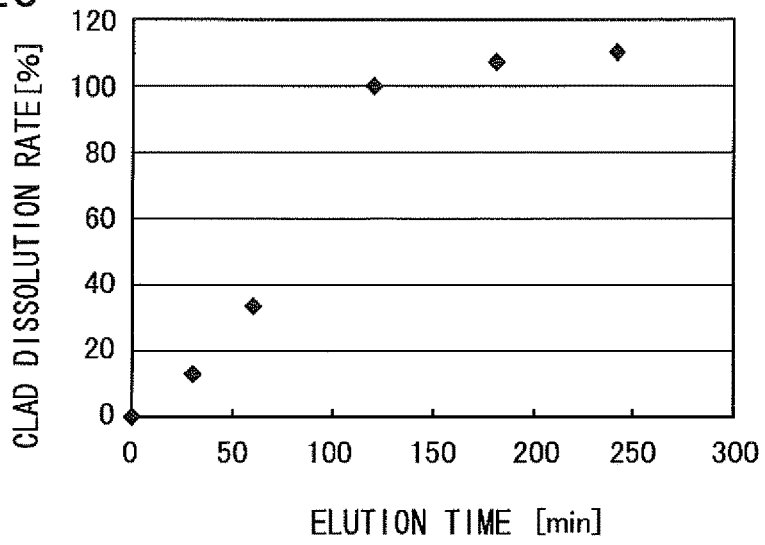
FIG. 23 is a graph showing results of Example 24.

As a result, as for Fe, as shown in FIG. 23, it was found that approximately 100% of the Fe amount in the simulated clad thus added is dissolved in the sulfuric acid eluent, and that after the simulated clad is dissolved, no re-adsorption thereof to the cation exchange membrane occurs. The reason the dissolution rate after 2 hours or more is more that 100% is the evaporation of water in the eluent caused by heating. As for Co, it was confirmed that approximately 100% of the Co amount in cobalt chloride thus added is eluted, and that Co ions can be preferably eluted from the resin.

Experimental Example 2

After $CoCl_2$, $FeCl_3$, and sulfuric acid were dissolved in water so that a simulated waste liquid having properties shown in Table 10 was prepared, and citric acid was dissolved in water so that a simulated electrodeposition liquid (cathode liquid) having properties shown in Table 10 was prepared, by the use of the apparatus shown in FIG. 1, an electrodeposition test of Co and Fe was performed. In FIG. 1, reference numeral 12 indicates a pipe returning an electrodeposition treated liquid to the acidic waste liquid storage bath 10. The electrodeposition conditions are as shown in Table 10. A Pt-plated Ti plate and a Cu plate were used as the anode and the cathode, respectively.

TABLE 10

<Conditions of Experimental Example 2>

| | Experimental Example 2 |
|---|---|
| Current [A] | 0.4 |
| Current Density [mA/cm$^2$] | 47.6 |
| Electrode Area, Membrane Area [cm$^{2-}$] | 8.4 |
| Anode Chamber Volume, Cathode Chamber Volume [mL] | 10.1 |

TABLE 10-continued

<Conditions of Experimental Example 2>

| | | Experimental Example 2 |
|---|---|---|
| Simulated Acidic Waste Liquid | Composition | Sulfuric Acid: 10 wt %<br>$CoCl_2$: 500 mg-Co/L<br>$FeCl_3$: 500 mg-Fe/L |
| | Volume [mL] | 100 mL |
| | pH | <0 |
| | Anode Chamber SV [hr$^{-1}$] | 4 |
| Simulated Electrodeposition Liquid | Composition | Citric Acid: 3.4 g/L |
| | Volume [mL] | 500 |
| | pH | 2.5 |
| | Cathode Chamber SV [hr$^{-1}$] | 30 |
| Voltage Application Time [hr] | | 6 |

When Co and Fe in the simulated acidic waste liquid after 6-hour voltage application were measured by an atomic absorption photometer, by the voltage application for 6 hours, 19% of Co and 10% of Fe in the simulated acidic waste liquid could be removed, and a black electrodeposition material was obtained on the cathode.

By this electrodeposition apparatus, without direct contact of a waste liquid having a strong acidity with the cathode, electrodeposition could be efficiently performed by moving metal ions into the cathode chamber through the cation exchange membrane.

Experimental Examples 3 to 9 and Comparative Experimental Examples 1 to 8

By the use of various types of additives, $CoCl_2$, and $FeCl_3$, electrodeposition liquids having the compositions shown in Table 11 were each prepared in a volume of 400 mL, and by the use of the apparatus shown in Table 6, the electrodeposition test was performed on electrodeposition liquids in each of which no suspended material was generated. The voltage application was performed at a current of 1 A (current density: 62.5 mA/cm$^2$) for 8 hours. A Pt-plated Ti plate and a Cu plate were used as the anode and the cathode, respectively.

In Table 11, the presence or the absence of the generation of a suspended material and the pH of the liquid before and after the voltage application are shown. As for the electrodeposition liquids of Experimental Examples 3 to 9 and Comparative Experimental Examples 2 and 6, in each of which no suspended material was present both before and after the voltage application, the results of analysis of the change in concentration of Co and Fe in the liquid with time are shown in FIGS. 24 and 25. From the result of the voltage application for 8 hours, it is found that in Experimental Examples 3 to 9, Co and Fe can be electrodeposited with time.

TABLE 11

<Electrodeposition Liquid Conditions and Confirmation Results of Suspended Material>

| | Composition of Electrodeposition Liquid | | | | Before Voltage Application | | After 8-Hour Voltage Application | |
|---|---|---|---|---|---|---|---|---|
| | Additive | | | | | | | |
| | Type | Addition Amount [X] | $CoCl_2$ [mg-Co/L] | $FeCl_3$ [mg-Fe/L] | pH | Suspended Material | pH | Suspended Material |
| Comparative Experimental Example 1 | None | — | 500 | 500 | 2.4 | ○None | 1.9 | xYes |
| Comparative Experimental Example 2 | Sodium Ethylenediaminetetraacetate | 20 | | | 8.6 | ○None | — | ○None |
| Comparative Experimental Example 3 | Oxalic Acid | 5 | | | 1.34 | xYes | — | — |
| Comparative Experimental Example 4 | Ethylenediamine | 5 | | | 10.1 | xYes | — | — |
| Experimental Example 3 | DL-Malic Acid | 5 | | | 1.7 | ○None | 1.8 | ○None |
| Comparative Experimental Example 5 | Tannic Acid | 0.5 | | | 1.8 | ○None | 1.7 | xYes |
| Experimental Example 4 | Sodium Tartrate | 5 | | | 4.5 | ○None | 9.1 | ○None |
| Experimental Example 5 | Iminodiacetic Acid | 5 | | | 1.9 | ○None | 1.9 | ○None |
| Comparative Experimental Example 6 | Ascorbic Acid | 5 | | | 1.9 | ○None | 1.4 | ○None |
| Experimental Example 6 | Succinic Acid | 5 | | | 1.7 | ○None | 1.6 | ○None |
| Experimental Example 7 | Malonic Acid | 5 | | | 1.5 | ○None | 1.5 | ○None |
| Comparative Experimental Example 7 | Gallic Acid | 2 | | | 1.8 | xYes | 1.6 | xYes |
| Comparative Experimental Example 8 | Glycine | 5 | | | 2.9 | ○None | 2.2 | xYes |
| Experimental Example 8 | Citric Acid Monohydrate | 5 | | | 1.5 | ○None | 1.3 | ○None |
| Experimental Example 9 | Citric Acid Monohydrate | 2 | | | 1.5 | ○None | 1.7 | ○None |

[X] Molar Amount Ratio (indicating the ratio of the molar amount to the total molar amount of Co and Fe.)

Although the present invention has been described in detail with reference to the specific aspects, it is apparent to a person skilled in the art that various modifications may be performed without departing from the spirit and the scope of the present invention.

This application claims the benefit of Japanese Patent Application No. 2013-221320 filed Oct. 24, 2013, No. 2013-221321 filed Oct. 24, 2013, No. 2013-221322 filed Oct. 24, 2013, and No. 2014-045235 filed Mar. 7, 2014, which are hereby incorporated by reference herein in their entirety.

The invention claimed is:

1. method for electrodepositing Co and Fe, comprising:

separating an anode chamber provided with an anode from a cathode chamber provided with a cathode by a cation exchange membrane, supplying a liquid containing Co ions and Fe ions and having pH 1 or less into the anode chamber, supplying a liquid containing at least one additive selected from a dicarboxylic acid and a salt thereof and a tricarboxylic acid and a salt thereof, each of which is represented by the following formula (1), into the cathode chamber, and applying a voltage between the anode and the cathode, so that the Co ions and the Fe ions in the liquid in the anode chamber are moved into the liquid in the cathode chamber through the cation exchange membrane, and Co and Fe are precipitated on the cathode:

$$M^1OOC—(CHX^1)_a—(NH)_b—(CX^2X^4)_c—CX^3X^5—COOM^2 \quad (1)$$

where, in the formula (1), $X^1$, $X^2$, and $X^3$ each independently represent H or OH, $X^4$ and $X^5$ each independently represent H, OH, or $COOM^3$, $M^1$, $M^2$, and $M^3$ each independently represent H, a monovalent alkali metal, or an ammonium ion, a, b, and c each independently represent an integer of 0 or 1, and $X^4$ and $X^5$ do not simultaneously represent $COOM^3$.

2. The method for electrodepositing Co and Fe according to claim 1, wherein the dicarboxylic acid is at least one selected from malonic acid, succinic acid, malic acid, tartaric acid, and iminodiacetic acid.

3. The method for electrodepositing Co and Fe according to claim 1, wherein the tricarboxylic acid is citric acid.

4. The method for electrodepositing Co and Fe according to claim 1, further comprising supplying an ammonium salt along with the liquid containing the at least one additive.

5. The method for electrodepositing Co and Fe according to claim 4, wherein the ammonium salt is at least one selected from ammonium chloride, ammonium sulfate, and ammonium oxalate.

6. The method for electrodepositing Co and Fe according to claim 4, further comprising supplying a liquid containing sulfuric acid or oxalic acid to the liquid containing the Co ions and the Fe ions, wherein a concentration of the ammonium salt in the liquid containing the Co ions and the Fe ions is 0.01 to 20 percent by weight, an acid concentration of the sulfuric acid in the liquid containing the Co ions and the Fe ions is 5 to 40 percent by weight, and an acid concentration of the oxalic acid in the liquid containing the Co ions and the Fe ions is 0.1 to 40 percent by weight.

7. The method for electrodepositing Co and Fe according to claim 1, wherein the tricarboxylic acid is ammonium citrate.

8. An apparatus for electrodepositing Co and Fe, comprising:

an electrodeposition bath which includes an anode chamber provided with an anode, a cathode chamber provided with a cathode, and a cation exchange membrane separating the anode chamber from the cathode chamber;

a voltage applicator for applying a voltage between the anode and the cathode;

a liquid passer for allowing a liquid containing Co ions and Fe ions and having pH 1 or less to pass through the anode chamber; and a liquid passer for allowing a liquid containing at least one additive selected from a dicarboxylic acid and a salt thereof and a tricarboxylic acid and a salt thereof, each of which is represented by the following formula (1), wherein by applying the voltage between the anode and the cathode, the Co ions and the Fe ions in the liquid in the anode chamber are moved into the liquid in the cathode chamber through the cation exchange membrane, and Co and Fe are precipitated on the cathode:

$$M^1OOC—(CHX^1)_a—(NH)_b—(CX^2X^4)_c—CX^3X^5—COOM^2 \quad (1)$$

where, in the formula (1), $X^1$, $X^2$, and $X^3$ each independently represent H or OH, $X^4$ and $X^5$ each independently represent H, OH, or $COOM^3$, $M^1$, $M^2$, and $M^3$ each independently represent H, a monovalent alkali metal, or an ammonium ion, a, b, and c each independently represent an integer of 0 or 1, and $X^4$ and $X^5$ do not simultaneously represent $COOM^3$.

9. The apparatus for electrodepositing Co and Fe according to claim 8, wherein the dicarboxylic acid is at least one selected from malonic acid, succinic acid, malic acid, tartaric acid, and iminodiacetic acid.

10. The apparatus for electrodepositing Co and Fe according to claim 8, wherein the tricarboxylic acid is citric acid.

11. The apparatus for electrodepositing Co and Fe according to claim 8, wherein the liquid containing the at least one additive further contains an ammonium salt.

12. The apparatus for electrodepositing Co and Fe according to claim 11, wherein the ammonium salt is at least one selected from ammonium chloride, ammonium sulfate, and ammonium oxalate.

13. The apparatus for electrodepositing Co and Fe according to claim 11, further comprising a storage bath storing a liquid containing sulfuric acid or oxalic acid supplied to the anode chamber, wherein a concentration of the ammonium salt in the liquid containing the Co ions and the Fe ions is 0.01 to 20 percent by weight, an acid concentration of the sulfuric acid in the liquid containing the Co ions and the Fe ions is 5 to 40 percent by weight, and an acid concentration of the oxalic acid in the liquid containing the Co ions and the Fe ions is 0.1 to 40 percent by weight.

14. The apparatus for electrodepositing Co and Fe according to claim 8, wherein the tricarboxylic acid is ammonium citrate.

* * * * *